US009346529B2

(12) United States Patent
Saruwatari et al.

(10) Patent No.: US 9,346,529 B2
(45) Date of Patent: May 24, 2016

(54) VESSEL PROPULSION APPARATUS

(71) Applicant: YAMAHA HATSUDOKI KABUSHIKI KAISHA, Iwata-shi, Shizuoka (JP)

(72) Inventors: Kimitaka Saruwatari, Shizuoka (JP); Kouichi Isozaki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/531,030

(22) Filed: Nov. 3, 2014

(65) Prior Publication Data

US 2015/0133009 A1 May 14, 2015

(30) Foreign Application Priority Data

Nov. 8, 2013 (JP) ..... 2013-232397

(51) Int. Cl.
*B63H 20/28* (2006.01)
*F01P 3/20* (2006.01)
*F01P 11/18* (2006.01)

(52) U.S. Cl.
CPC ..... *B63H 20/28* (2013.01); *F01P 3/202* (2013.01); *F01P 11/18* (2013.01)

(58) Field of Classification Search
CPC ..... B63H 20/28; B63H 21/38; B63H 20/00; B63H 21/10; F01P 5/10; F01P 3/02; F01P 3/12
USPC ..... 440/88 L, 88 P; 123/195 P, 41.09, 41.31
See application file for complete search history.

(56) References Cited

U.S. PATENT DOCUMENTS 4,498,875 A * 2/1985 Watanabe ..... F02B 61/045 440/88 L
5,715,777 A * 2/1998 Wada ..... F01P 7/16 123/195 P
5,873,330 A * 2/1999 Takahashi ..... F01N 3/043 123/195 P
6,347,969 B1 * 2/2002 Takahashi ..... F01P 3/02 440/88 R
6,416,372 B1 * 7/2002 Nozue ..... F01M 11/0004 440/88 R
8,475,222 B2 * 7/2013 Ishizaka ..... B63H 20/28 440/88 C

FOREIGN PATENT DOCUMENTS

JP 2000-337145 A 12/2000

* cited by examiner

*Primary Examiner* — Lars A Olson
(74) *Attorney, Agent, or Firm* — Keating and Bennett, LLP

(57) ABSTRACT

A vessel propulsion apparatus includes a water pump that is driven by an engine, and supplies water from an water inlet to the engine via a cooling water supply passage. The vessel propulsion apparatus includes an auxiliary cooling passage branching from the cooling water supply passage to extend to an oil pan. A water pressure control valve disposed at a branch position from the cooling water supply passage to the auxiliary cooling passage limits the flow rate of water flowing to the auxiliary cooling passage when a water pressure inside the cooling water supply passage is less than a set pressure. The water pressure control valve is configured to allow a portion of the water inside the cooling water supply passage to flow to the auxiliary cooling passage when the water pressure inside the cooling water supply passage is the set pressure or more to maintain the water pressure to be less than the set pressure while supplying water to the oil pan via the auxiliary cooling passage.

15 Claims, 16 Drawing Sheets

VESSEL PROPULSION APPARATUS

BACKGROUND OF THE INVENTION

1. Field of the Invention

The present invention relates to a vessel propulsion apparatus.

2. Description of the Related Art

For example, Japanese Patent Application Publication No. 2000-337145 discloses an outboard motor that leads cooling water to an engine via a cooling water passage defined inside an oil pan. The outboard motor includes a transverse cooling water passage defined in a bottom surface of the oil pan, a relief port extending downward from the transverse cooling water passage, and a water pressure valve attached to the relief port. When the pressure inside the cooling water passage rises, a portion of the cooling water inside the cooling water passage is released downward from the bottom surface of the oil pan through the water pressure valve.

SUMMARY OF THE INVENTION

The inventor of preferred embodiments of the present invention described and claimed in the present application conducted an extensive study and research regarding a vessel propulsion apparatus, such as the one described above, and in doing so, discovered and first recognized new unique challenges and previously unrecognized possibilities for improvements as described in greater detail below.

It is desirable that the engine oil temperature is constant regardless of the operation conditions of the engine. On the other hand, the amount of heat to be generated by moving parts of the engine, etc., changes according to the operation conditions of the engine such as the rotation speed. Thus, in order to maintain the engine oil temperature constant, it is necessary to change the cooling ability of a cooling device according to the operation conditions of the engine.

However, in the outboard motor described in the related art above, the transverse cooling water passage and vertical cooling water passage are filled with cooling water in either state where the water pressure valve is open or closed. Therefore, the contact area of the cooling water with the oil pan is constant irrespective of the operation conditions of the engine, and the cooling ability to cool oil inside the oil pan remains nearly unchanged.

In order to overcome the previously unrecognized and unsolved challenges described above, a preferred embodiment of the present invention provides a vessel propulsion apparatus including an engine configured to generate power to propel a vessel, an oil pan configured to retain lubricating oil to be supplied to the engine, a water inlet disposed under the engine, a cooling water supply passage extending from the water inlet to the engine, a water pump that is disposed in the cooling water supply passage and is configured to take in water outside of the vessel propulsion apparatus from the water inlet and supply the taken-in water to the engine via the cooling water supply passage, by being driven by the engine, an auxiliary cooling passage branching from the cooling water supply passage at a branch position between the engine and the water pump, extending from the branch position to the oil pan, and a pressure control valve configured to perform flow rate limitation to limit the flow rate of water flowing from the cooling water supply passage to the auxiliary cooling passage when the water pressure inside the cooling water supply passage is less than a set pressure, and cancel the flow rate limitation to allow a portion of the water inside the cooling water supply passage flow to the auxiliary cooling passage when the water pressure inside the cooling water supply passage is the set pressure or more to thus maintain the water pressure inside the cooling water supply passage to be less than the set pressure, and supply water to the oil pan via the auxiliary cooling passage.

According to this arrangement, when the output of the engine is low, the water pressure inside the cooling water supply passage is low. When the output of the engine is high, the water pressure inside the cooling water supply passage is high. When the water pressure inside the cooling water supply passage is less than a set pressure, because the flow rate of water flowing from the cooling water supply passage to the auxiliary cooling passage is limited, the flow rate of water to be supplied to the oil pan via the auxiliary cooling passage is also limited. The cooling ability is thus suppressed. When the water pressure inside the cooling water supply passage is the set pressure or more, low-temperature water before engine cooling flows from the cooling water supply passage to the auxiliary cooling passage, and is supplied to the oil pan via the auxiliary cooling passage. The cooling ability to cool lubricating oil inside the oil pan is thus enhanced. Thus, a temperature difference of the lubricating oil between when the output of the engine is high and low is significantly reduced.

The flow rate limitation preferably includes a shutoff in which the pressure control valve shuts off flow-through of water from the cooling water supply passage to the auxiliary cooling passage, and the pressure control valve may keep the inside of the auxiliary cooling passage empty by shutting off flow-through of water from the cooling water supply passage to the auxiliary cooling passage when the water pressure inside the cooling water supply passage is less than the set pressure.

According to this arrangement, when the output of the engine is low, the flow of water to the auxiliary cooling passage is shut off to cancel cooling of the oil pan by water in the auxiliary cooling passage. Excessively cooling the lubricating oil is thus suppressed or prevented when the output of the engine is low. A temperature difference of the lubricating oil between when the output of the engine is high and low is thus significantly reduced.

The auxiliary cooling passage preferably branches from the cooling water supply passage at the branch position higher than the oil pan, and the pressure control valve preferably is disposed higher than the oil pan.

According to this arrangement, the length of the auxiliary cooling passage that contributes to cooling is extended. The cooling ability when the engine output is large is thus enhanced.

The auxiliary cooling passage preferably extends along the oil pan from the upper end of the oil pan up to the lower end of the oil pan.

According to this arrangement, the length of the auxiliary cooling passage that contributes to cooling is markedly extended. The cooling ability when the engine output is large is thus markedly enhanced.

The oil pan preferably includes an oil retaining portion that is configured to retain lubricating oil to be supplied to the engine, and the auxiliary cooling passage preferably extends along an outer wall surface of the oil retaining portion.

According to this arrangement, the outer wall surface of the oil retaining portion is effectively cooled by water flowing inside the auxiliary cooling passage. The cooling ability to cool lubricating oil inside the oil retaining portion is thus enhanced.

The cooling water supply passage preferably extends from the water inlet to the engine, and extends along the oil pan.

According to this arrangement, the cooling ability is further enhanced by cooling the oil pan by low-temperature water before engine cooling flowing inside the cooling water supply passage.

The vessel propulsion apparatus preferably further includes a cooling water exhaust passage that extends from the engine to the oil pan and through which water supplied from the cooling water supply passage to the engine flows.

According to this arrangement, the cooling ability is further enhanced by also causing water after cooling the engine contribute to cooling of the oil pan.

The cooling water supply passage preferably includes a water feed portion provided in the interior of the oil pan, the cooling water discharge passage preferably includes a drain portion provided in the interior of the oil pan, the auxiliary cooling passage preferably includes an auxiliary cooling portion provided in the interior of the oil pan, and the water feed portion, the drain portion, and the auxiliary cooling portion preferably do not intersect in the interior of the oil pan.

According to this arrangement, the contact area of the oil pan with water is increased inside the oil pan. The cooling ability to cool lubricating oil inside the oil retaining portion is thus further enhanced.

The water pump preferably includes a rotor that is driven to rotate by the engine so that the discharge flow rate of water increases with an increase in the rotation speed of the engine.

According to this arrangement, by controlling the amount of water to be supplied to the oil pan via the auxiliary cooling passage according to the water pressure inside the cooling water supply passage that increases or decreases depending on the rotation speed of the engine, the cooling ability is controlled.

The pressure control valve preferably includes a valve seat that defines a hole through which water flowing to a downstream side of the auxiliary cooling passage passes, and a valve body that opens and closes the hole by contacting and separating from the valve seat according to the water pressure inside the cooling water supply passage.

According to this arrangement, by the valve body opening and closing the valve seat, the amount of water flowing to the downstream side of the auxiliary cooling passage is controlled. The valve body closing the valve seat when the output of the engine is low is easily shut off the flow-through of water to the auxiliary cooling passage. Excessively cooling the lubricating oil is also suppressed when the output of the engine is low. A temperature difference of the lubricating oil between when the output of the engine is high and low is further reduced as much as possible.

The pressure control valve preferably further includes an electric actuator configured to move the valve body.

According to this arrangement, the valve body is moved by the electric actuator to open and close the valve seat.

The engine preferably includes a crankshaft that is rotatable about a rotation axis extending in an up-down direction.

The vessel propulsion apparatus preferably includes a drive shaft that is disposed under the crankshaft and coupled with the crankshaft in an integrally rotatable manner, and that drives the water pump, a casing including an insertion hole through which the drive shaft is inserted and a bearing holding portion provided on the inner periphery of the insertion hole, and a bearing that is held by the bearing holding portion and rotatably supports an axially halfway portion of the drive shaft.

Conventionally, a bearing to support a lower end portion of a drive shaft has been provided. However, in the drive shaft, a substantial support span corresponding to the distance from its upper end portion connected to the crankshaft to the bearing is long. Therefore, there is a problem that the drive shaft has a great swing. In contrast thereto, in the present arrangement, the substantial support span corresponding to the distance from the upper end portion of the drive shaft to the bearing is significantly reduced. The swing of the drive shaft is thus suppressed to be small.

The vessel propulsion apparatus preferably includes a bearing holder held by the bearing holding portion, including a cylindrical elastic member that holds the bearing.

According to this arrangement, by elastic deformation of the bearing holder, errors in the dimensional accuracy and the positional accuracy of combination, etc., of the drive shaft and casing are absorbed.

The vessel propulsion apparatus preferably includes a branch passage branching from a halfway portion of the cooling water supply passage, passing through a portion of the bearing holding portion to communicate with the insertion hole, and the bearing preferably includes a cylindrical sliding bearing that makes sliding contact with the outer periphery of the halfway portion of the drive shaft.

According to this arrangement, frictional heat generated by sliding contact between the drive shaft and sliding bearing is transmitted to the bearing holder. However, because water flowing in the branch passage branching from the cooling water supply passage passes through a portion of the bearing holding portion, a rise in temperature of the bearing holder is significantly suppressed or prevented. A deterioration of the bearing holder is thus prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
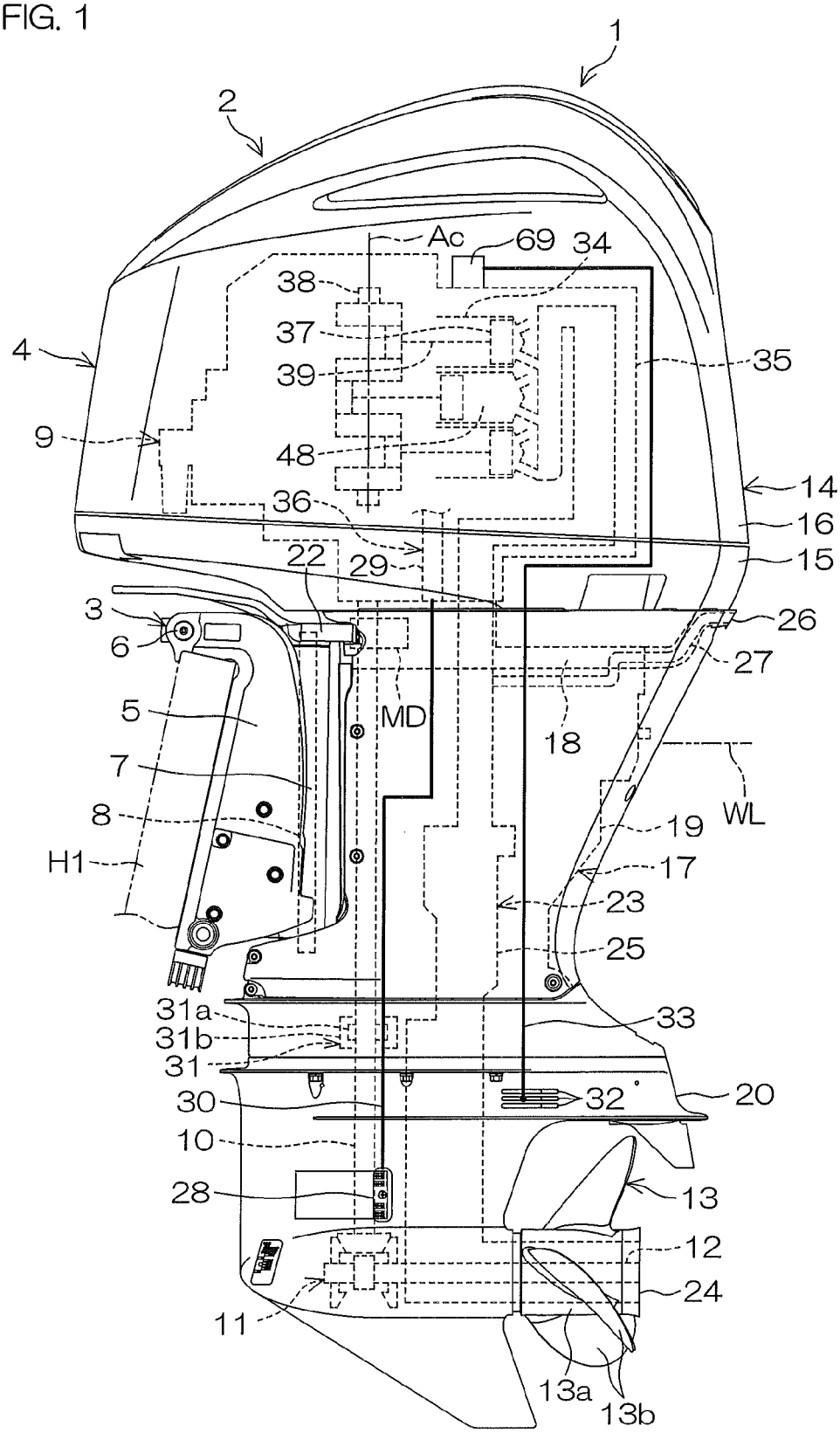
FIG. 1 is a schematic side view of a vessel propulsion apparatus according to a first preferred embodiment of the present invention.

FIG. 1 is a schematic side view showing a vessel 1 according to a first preferred embodiment of the present invention. As shown in FIG. 1, the vessel 1 includes a hull H1 that is configured to float on a water surface and a vessel propulsion apparatus 2 that is configured to drive the hull H1 forward and rearward. In the present preferred embodiment, description will be given in line with an example in which the vessel propulsion apparatus 2 is a suspension device 3 that is mountable on a rear portion (stern) of the hull H1 and an outboard motor 4 coupled to the suspension device 3.

The suspension device 3 includes a pair of left and right clamp brackets 5 to be mounted on the hull H1, a tilting shaft 6 supported in a posture of extending in the left-right direction by the pair of clamp brackets 5, and a swivel bracket 7 mounted on the tilting shaft 6. The suspension device 3 further includes a steering shaft 8 supported in a posture of extending in the up-down direction by the swivel bracket 7.

The outboard motor 4 is mounted on the steering shaft 8. The steering shaft 8 is supported by the swivel bracket 7 so as to be rotatable about a steering axis (center line of the steering shaft 8) extending in the up-down direction. The swivel bracket 7 is supported by the clamp brackets 5 via the tilting shaft 6. The swivel bracket 7 is turnable about a tilt axis (center line of the tilting shaft 6) extending in the left-right direction, with respect to the clamp brackets 5. The outboard motor 4 is turnable to the left and right with respect to the suspension device 3, and is turnable up and down with respect to the suspension device 3. Thus, the outboard motor 4 is turnable to the left and right with respect to the hull H1, and is turnable up and down with respect to the hull H1.

Also, the vessel 1 preferably includes a steering bracket 22 to be mounted on the steering shaft 8 in an integrally rotatable manner, and a mount damper MD configured to function as a mount that couples the steering bracket 22 and an exhaust guide 18 to be described later of the outboard motor 4. The mount damper MD is interposed between the hull H1 and the outboard motor 4, and is configured to significantly reduce or prevent vibration of the outboard motor 4 from being transmitted to the hull H1.

The outboard motor 4 includes an engine 9 that generates power to rotate a propeller 13 and propel the hull 1 and a power transmission system that transmits the power of the engine 9 to the propeller 13. The power transmission system includes a drive shaft 10 coupled to the engine 9, a forward/reverse switching mechanism 11 coupled to the drive shaft 10, and a propeller shaft 12 coupled to the forward/reverse switching mechanism 11. The outboard motor 4 further includes an engine cover 14 that covers the engine 9 and a casing 17 that houses the power transmission system.

The engine cover 14 houses the engine 9. The engine cover 14 includes a cup-shaped bottom cover 15 opened upward, and a cup-shaped top cover 16 opened downward. The top cover 16 is removably mounted on the bottom cover 15. The opening portion of the top cover 16 is laid on the opening portion of the bottom cover 15 via a seal (not shown) one on the top of the other. The bottom cover 15 is mounted on the casing 17 (specifically, an exhaust guide 18 to be described later).

The casing 17 includes an exhaust guide 18 disposed under the engine 9, an upper case 19 disposed under the exhaust guide 18, and a lower case 20 disposed under the upper case 19. The engine 9 is mounted on the exhaust guide 18. The engine 9 is disposed higher than the steering shaft 8. The exhaust guide 18 defining and serving as an engine support member supports the engine 9 with a rotation axis of the engine 9 (corresponding to a rotation axis Ac of a crankshaft 38) being in a vertical posture.

The engine 9 is disposed over the drive shaft 10. The drive shaft 10 extends in the up-down direction inside the casing 17. A center line of the drive shaft 10 preferably is disposed on the rotation axis of the engine 9, and preferably is deviated with the rotation axis of the engine 9. An upper end portion of the drive shaft 10 is coupled to the engine 9. A lower end portion of the drive shaft 10 is coupled to a front end portion of the propeller shaft 12 via the forward/reverse switching mechanism 11. The propeller shaft 12 extends in the front-rear direction inside the casing 17. A rear end portion of the propeller shaft 12 projects rearward from the casing 17. The propeller 13 is removably mounted on the rear end portion of the propeller shaft 12. The propeller 13 includes an outer cylinder 13*a* surrounding the propeller shaft 12 about a propeller axis (center line of the propeller shaft 12), and a plurality of blades 13*b* extending outward from the outer cylinder 13*a*. The outer cylinder 13*a* and the blades 13*b* rotate about the propeller axis together with the propeller shaft 12.

The engine 9 preferably is an internal combustion engine. The engine 9 rotates in a fixed rotation direction. The rotation of the engine 9 is transmitted to the propeller 13 by the power transmission system (the drive shaft 10, the forward/reverse switching mechanism 11, and the propeller shaft 12). The propeller 13 is thus caused to rotate together with the propeller shaft 12 and a thrust that propels the vessel 1 forward or in reverse is generated. Also, the direction of a rotation transmitted from the drive shaft 10 up to the propeller shaft 12 is switched by the forward/reverse switching mechanism 11. The rotation direction of the propeller 13 and the propeller shaft 12 is thus switched between a normal rotation direction (clockwise direction when the propeller 13 is viewed from the rear) and a reverse rotation direction (direction of rotation opposite to the normal rotation direction). The direction of thrust is thus switched.

The outboard motor 4 includes an exhaust passage 23 that discharges exhaust generated by the engine 9 to the outside of the outboard motor 4. The exhaust passage 23 is provided in the interior of the outboard motor 4. The exhaust passage 23 includes an exhaust port 24 opening at a rear end portion of the propeller 13 (a rear end portion of the outer cylinder 13*a*), and a main exhaust passage 25 extending from a combustion chamber 48 of the engine 9 to the exhaust port 24. The exhaust passage 23 further includes an idle exhaust port 26 opening at an outer surface of the outboard motor 4, and an idle exhaust passage 27 extending from the main exhaust passage 25 to the idle exhaust port 26.

The main exhaust passage 25 extends downward from the engine 9 to the propeller shaft 12 via the exhaust guide 18, and extends rearward along the propeller shaft 12. The main exhaust passage 25 opens rearward at the rear end portion of the propeller 13. The exhaust port 24 is thus disposed in water. The idle exhaust port 26 and the idle exhaust passage 27 are disposed higher than the exhaust port 24. The idle exhaust passage 27 branches from the main exhaust passage 25. The idle exhaust port 26 is disposed higher than a waterline WL (height of the water surface when the vessel 1 equipped with the vessel propulsion apparatus 2 is stopped). The idle exhaust port 26 thus opens into air.

The exhaust generated in the combustion chamber 48 is discharged into the main exhaust passage 25, and is guided toward the exhaust port 24. When the output of the engine 9 is high, the exhaust inside the main exhaust passage 25 is mainly discharged into water from the exhaust port 24. Also, a portion of the exhaust inside the main exhaust passage 25 is led to the idle exhaust port 26 by the idle exhaust passage 27, and is released into the atmosphere from the idle exhaust port 26. On the other hand, when the output of the engine 9 is low (for example, when the engine 9 is idling), the exhaust pressure inside the main exhaust passage 25 is low and the exhaust inside the main exhaust passage 25 is thus mainly released into the atmosphere from the idle exhaust port 26.

The outboard motor 4 preferably includes a water-cooled type cooling device 36 that cools the interior of the outboard motor 4. The cooling device 36 includes a water inlet 28 disposed under the engine 9 and opening at the outer surface of the outboard motor 4, and a cooling water passage 29 (water jacket) provided in the engine 9. The cooling device 36 further includes a cooling water supply passage 30 extending from the water inlet 28 to the engine 9 to connect to the cooling water passage 29 inside the engine 9, and a water pump 31 disposed in the cooling water supply passage 30. The water pump 31 takes water outside the outboard motor 4 serving as cooling water into the interior of the outboard motor 4 from the water inlet 28, and supplies the taken-in water to the engine 9 via the cooling water supply passage 30. The cooling device 36 further includes a water outlet 32 opening at an outer surface of the lower case 20, and a cooling water drain passage 33 through which water supplied from the cooling water supply passage 30 to the engine 9 flows. The cooling water drain passage 33 extends inside the outboard motor 4 from the cooling water passage 29 to the water outlet 32.

The water inlet 28 is disposed lower than the cooling water passage 29 and the water pump 31. The water inlet 28 opens at the outer surface of the lower case 20. The water inlet 28 is thus disposed in water. The water inlet 28 is connected to the cooling water passage 29 inside the engine 9 via the cooling water supply passage 30 provided in the interior of the outboard motor 4. The water pump 31 is disposed in the cooling water supply passage 30. The water pump 31 is thus disposed in the interior of the outboard motor 4. The water pump 31 is disposed lower than the engine 9.

The water pump 31 is mounted on the drive shaft 10. The water pump 31 preferably is a rotary pump including an impeller 31*a* defining and serving as a rotor that rotates together with the drive shaft 10, and a pump case 31*b* that houses the impeller 31*a*. When the engine 9 rotates the drive shaft 10, the impeller 31*a* rotates inside the pump case 31*b* and a suction force to suck water outside the outboard motor 4 into the water inlet 28 is generated. The water pump 31 is thus driven by the engine 9. The impeller 31*a* defining and serving as a rotor is driven to rotate by the engine 9 such that the flow rate of water increases with an increase in the rotation speed of the engine 9.

The water outside the outboard motor 4 defining and serving as cooling water is sucked from the water inlet 28 into the cooling water supply passage 30, and is delivered from the cooling water supply passage 30 to the cooling water passage 29 (water jacket) inside the engine 9 via the water pump 31. High-temperature portions of the engine 9 etc., are thus cooled by the cooling water. Then, the cooling water supplied to the engine 9 is guided by the cooling water drain passage 33 to the water outlet 32, and is discharged from the water outlet 32.

The engine 9 includes an engine main body 35 provided with a plurality of cylinders 34. The engine 9 may be an in-line engine or a V-type engine, or may be an engine of a type other than these, for example. Also, the engine 9 is not limited to being a multi-cylinder engine and may instead be a single-cylinder engine, for example. The engine main body 35 includes a plurality of pistons 37 respectively disposed inside the plurality of cylinders 34, a crankshaft 38 that is rotatable about the rotation axis Ac extending in the up-down direction, and a plurality of connecting rods 39 that couple each of the plurality of pistons 37 to the crankshaft 38.

Figure 2:
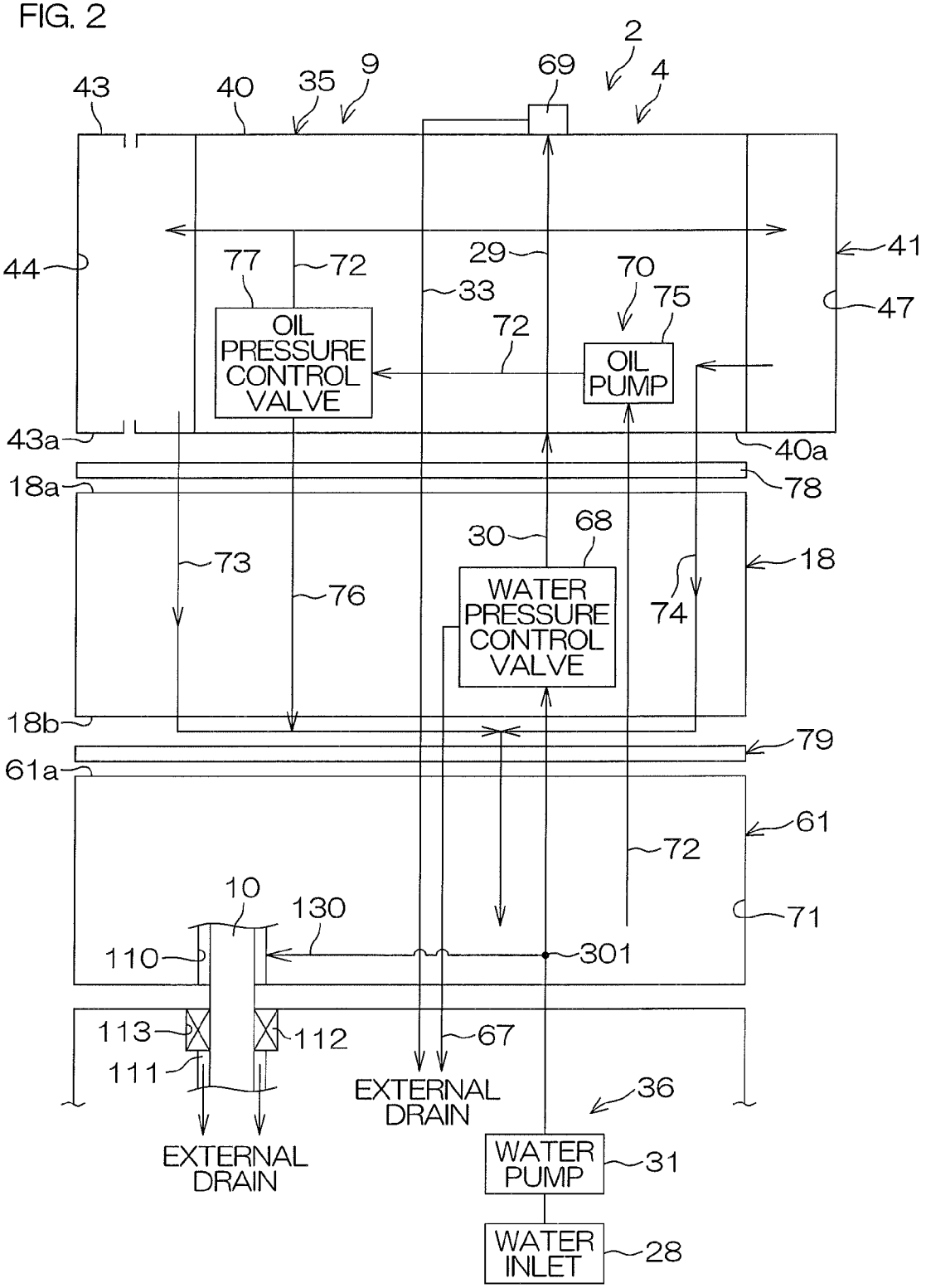
FIG. 2 is a block diagram schematically showing flows of cooling water and lubricating oil.

FIG. 2 is a block diagram schematically showing an example of flows of cooling water and lubricating oil. As shown in FIG. 2, the cooling device 36 includes an auxiliary cooling passage 67 branching from the cooling water supply passage 30 at a branch position between the engine 9 and the water pump 31 and extending to the oil pan 61 from the branch position, and a water pressure control valve 68 defining and serving as a pressure control valve disposed at the branch position. The water pressure control valve 68 (pressure control valve) performs flow rate limitation to limit the flow rate of water flowing from the cooling water supply passage 30 to the auxiliary cooling passage 67 when the water pressure inside the cooling water supply passage 30 is less than a set pressure. The water pressure control valve 68 is configured to cancel the flow rate limitation to allow a portion of the water inside the cooling water supply passage 30 to flow to the auxiliary cooling passage 67 when the water pressure inside the cooling water supply passage 30 is the set pressure or more to maintain the water pressure inside the cooling water supply passage 30 to be less than the set pressure, and to supply water to the oil pan 61 via the auxiliary cooling passage 67.

The flow rate limitation includes a shutoff in which the pressure control valve 68 shuts off flow-through of water from the cooling water supply passage 30 to the auxiliary cooling passage 67. That is, the water pressure control valve 68 is configured to perform the function of keeping the inside of the auxiliary cooling passage 67 empty by shutting off flow-through of water from the cooling water supply passage 30 to the auxiliary cooling passage 67 when the water pressure inside the cooling water supply passage 30 is less than the set pressure.

The cooling device 36 further includes a thermostat 69 that is configured to open and close the cooling water passage 29 according to the temperature of the cooling water inside the cooling water passage 29. The thermostat 69 is disposed on, for example, the cylinder body 40. When the cooling water passage 29 is opened by the thermostat 69, the water inside the cooling water passage 29 is discharged to the exterior via the cooling water discharge passage 33 that extends from the engine 9 to the oil pan 61 downstream of the thermostat 69. A portion of the cooling water discharge passage 33 is defined in the exhaust guide 18 and the oil pan 61.

As shown in FIG. 2, the drive shaft 10 is inserted through an insertion hole 110 provided in the oil pan 61 and an insertion hole 111 provided in the upper case 19. A bearing 112 held in the upper case 19 is configured to rotatably support an axially halfway portion of the drive shaft 10. A portion of the inner periphery of the insertion hole 111 of the upper case 19 is increased in diameter to define a bearing holding portion 113. The bearing 112 is held by the bearing holding portion 113. The bearing holding portion 113 may be defined in the insertion hole 110 of the oil pan 61. Also, the bearing holding portion 113 may extend across the insertion hole 110 of the oil pan 61 and the insertion hole 111 of the upper case 19.

The oil pan 61 includes a branch passage 130 branching from a branch position 301 of the cooling water supply passage 30 to communicate with the insertion hole 110. Water that is supplied to the insertion hole 110 via the branch passage 130 from the cooling water supply passage 30 passes through the bearing 112, and is discharged to the exterior via the insertion hole 111. As a result of the bearing 112 being cooled by water supplied to the insertion hole 110 via a branch passage 130, a rise in temperature of the bearing 112 is suppressed or prevented. A deterioration of rubber to be described later included in the bearing 112 is thus suppressed or prevented.

The outboard motor 4 includes a lubricating device 70. The lubricating device 70 includes the oil pan 61 including an oil retaining portion 71 configured to retain lubricating oil to be supplied to the engine 9, and disposed under the engine 9. The lubricating device 70 further includes an oil supply passage 72 configured to lead lubricating oil in the oil retaining portion 71 to at least the crank chamber 44 of the engine 9. In the present first preferred embodiment, description will be given in line with the example in which lubricating oil is led to the crank chamber 44 and the cam chamber 47 shown in FIG. 2.

The lubricating device 70 further includes a first oil recovery passage 73 that extends downward from the crank chamber 44 to the oil retaining portion 71 and is configured to lead lubricating oil inside the crank chamber 44 to the oil retaining portion 71 of the oil pan 61. The lubricating device 70 further includes a second oil recovery passage 74 that is configured to return lubricating oil used for lubrication inside the cam chamber 47 to the oil retaining portion 71 of the oil pan 61.

The lubricating device 70 further includes an oil pump 75 disposed in a halfway portion of the oil supply passage 72 and configured to be driven by the engine 9, a third oil recovery passage 76 branching from a branch position disposed downstream of the oil pump 75 in the oil supply passage 72, and an oil pressure control valve 77 disposed at the branch position.

The oil pressure control valve 77 defines and serves as a relief function of returning a portion of the lubricating oil in the oil supply passage 72 to the oil retaining portion 71 of the oil pan 61 via the third oil recovery passage 76 when the pressure of the lubricating oil has reached a set pressure or more. The pressure of the lubricating oil inside the oil supply passage 72 is thus maintained to be less than the set pressure.

The outboard motor 4 includes an engine gasket 78 and an oil pan gasket 79. The engine gasket 78 is disposed between the engine 9 and the oil pan 61. The exhaust guide 18 is disposed between the engine gasket 78 and the oil pan 61. The oil pan gasket 79 is disposed between the exhaust guide 18 and the oil pan 61. Specifically, the engine gasket 78 is disposed between a lower end portion 40*a* of the cylinder body 40 and a lower end portion 43*a* of the crank case 43 and an upper end 18*a* of the exhaust guide 18. The oil pan gasket 79 is disposed between a lower end 18*b* of the exhaust guide 18 and an upper end 61*a* of the oil pan 61. In the respective gaskets 78 and 79, holes (which are not shown in FIG. 2 being a schematic view) through which corresponding oil and blowby gas are passed are respectively defined.

Figure 3:
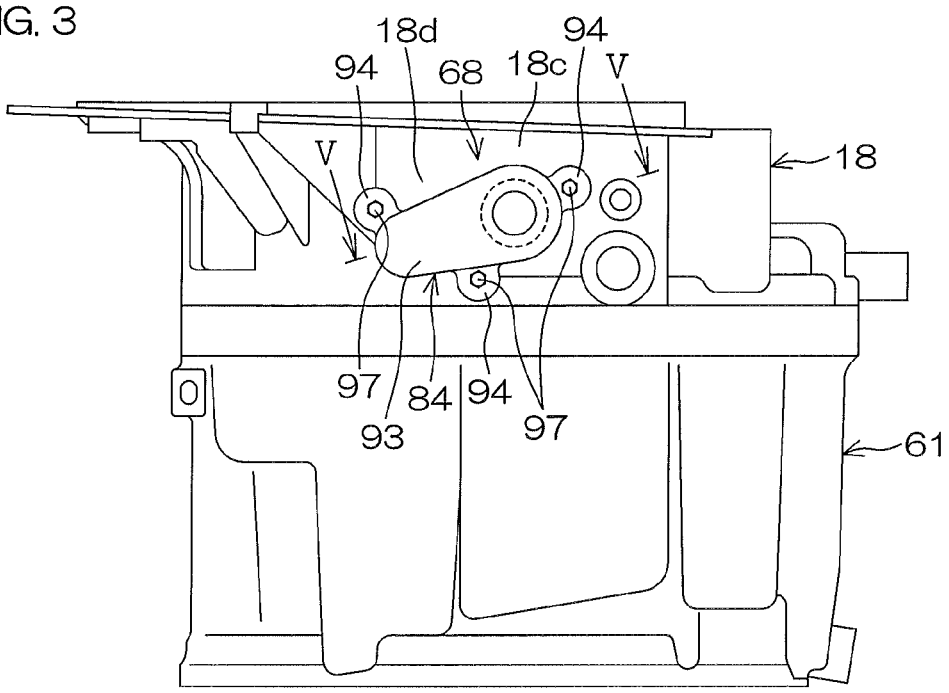
FIG. 3 is a side view of an exhaust guide and an oil pan, and shows a state in which a water pressure control valve is fitted.
Figure 4:
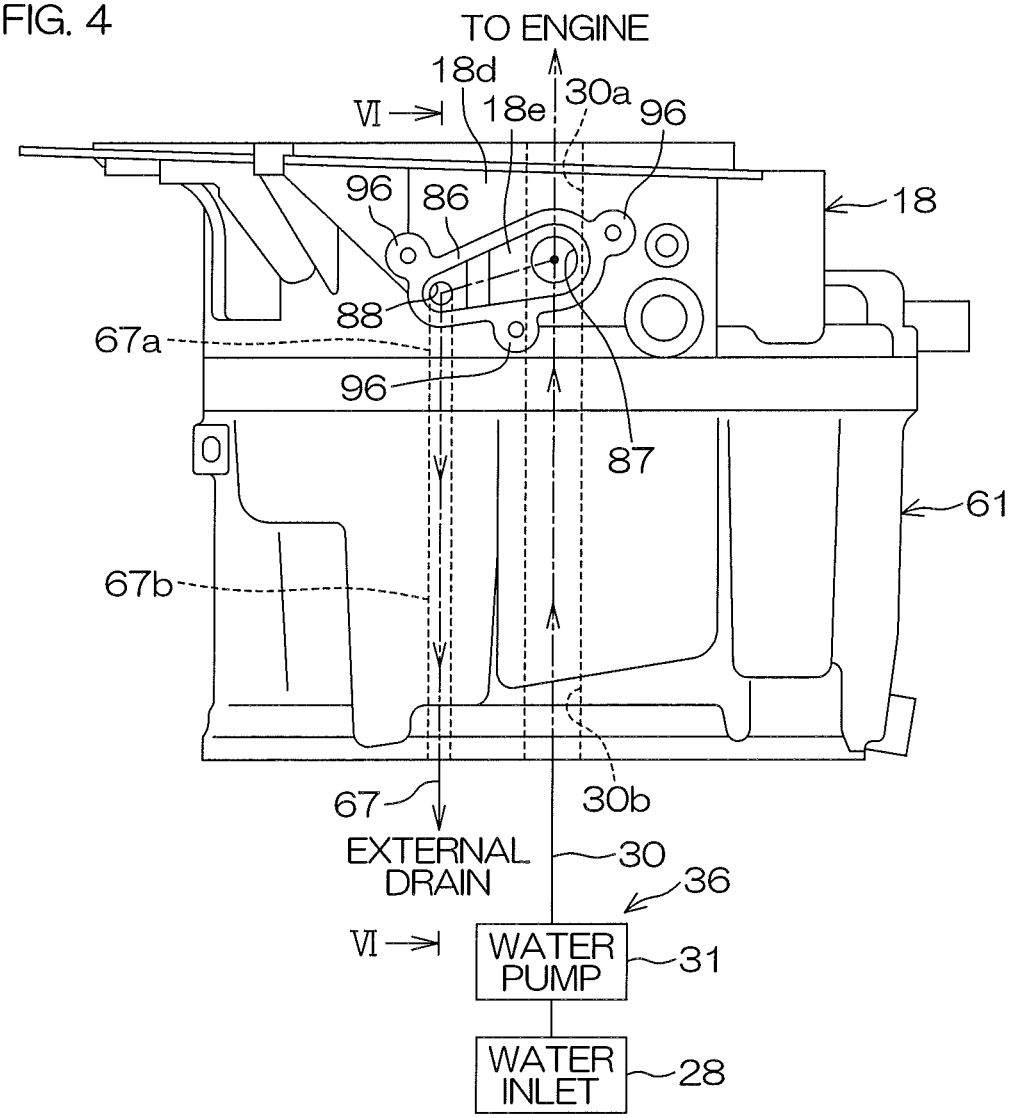
FIG. 4 is a schematic side view of the exhaust guide and the oil pan, and shows a state in which the water pressure control valve is removed.
Figure 5:
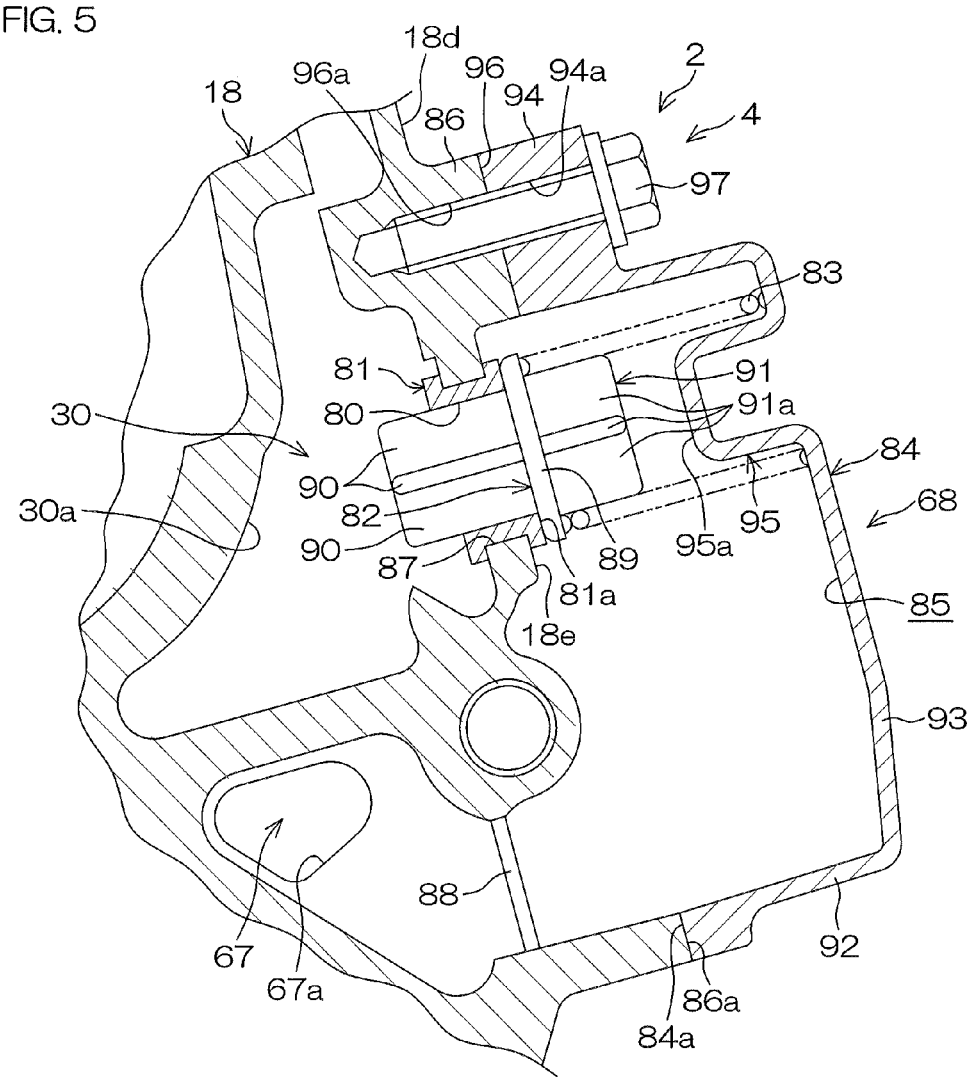
FIG. 5 is a sectional view of the principal portion of the exhaust guide and the water pressure control valve in a closed state, and shows a section cut along line V-V in FIG. 3 in an enlarged manner.
Figure 6:
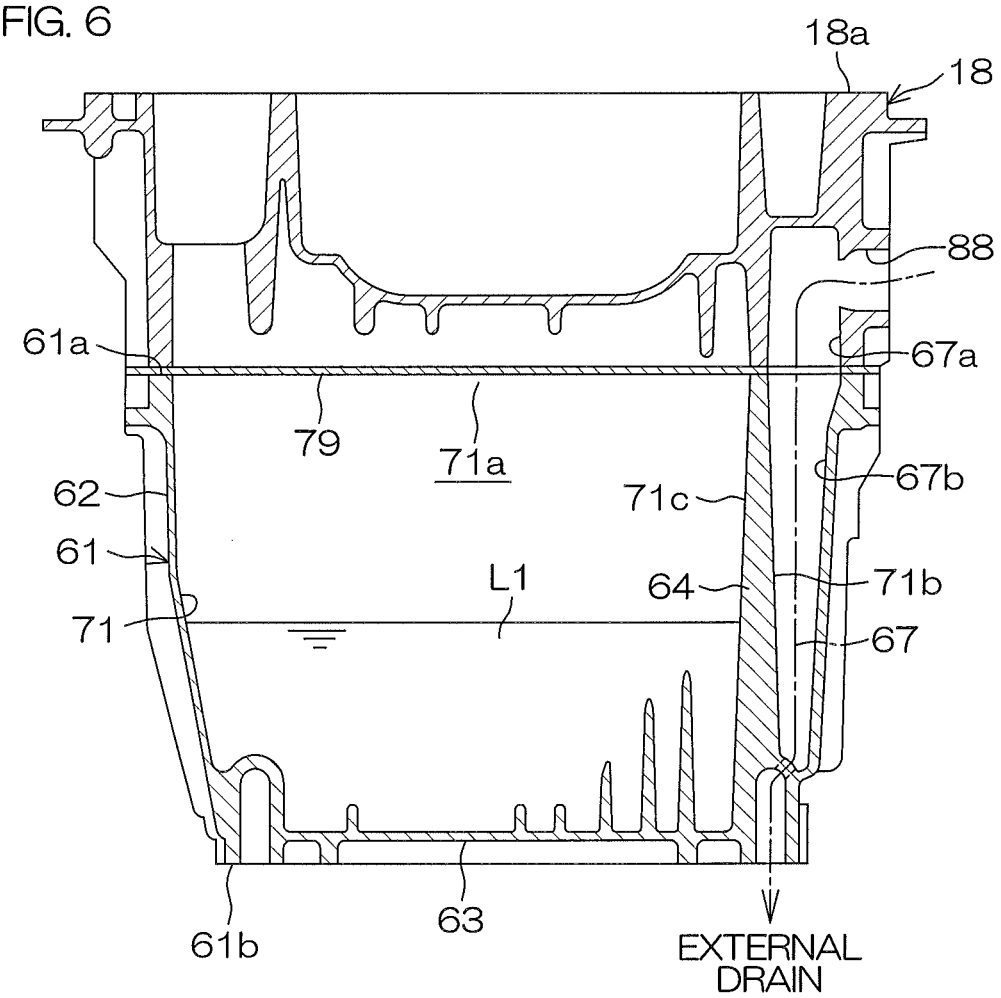
FIG. 6 is a schematic longitudinal sectional view of the exhaust guide and the oil pan, and shows a section cut along line VI-VI in FIG. 4.

FIG. 3 is a schematic side view of the exhaust guide 18 and the oil pan 61, and shows a state in which the water pressure control valve 68 is fitted. FIG. 4 is a schematic side view of the exhaust guide 18 and the oil pan 61, and shows a state in which the water pressure control valve 68 is removed. FIG. 5 is an enlarged sectional view taken along line V-V in FIG. 3. FIG. 6 is a sectional view taken along line VI-VI in FIG. 4.

As shown in FIG. 3, the exhaust guide 18 is disposed over the oil pan 61. The water pressure control valve 68 is disposed in a side portion 18*c* of the exhaust guide 18 disposed over the oil pan 61. The water pressure control valve 68 is thus disposed higher than the oil pan 61. As shown in FIG. 4, the auxiliary cooling passage 67 branches from the cooling water supply passage 30 at a branch position higher than the oil pan 61.

As shown in FIG. 4, the exhaust guide 18 includes a water feed portion 30*a* including a portion of the cooling water supply passage 30. The water feed portion 30*a* of the cooling water supply passage 30 extends in the up-down direction inside the exhaust guide 18. The oil pan 61 includes a water feed portion 30*b* including a portion of the cooling water supply passage 30. The water feed portion 30*b* inside the oil pan 61 communicates with the water feed portion 30*a* inside the exhaust guide 18. The exhaust guide 18 includes a portion 67*a* defined by a portion of the auxiliary cooling passage 67. The oil pan 61 includes an auxiliary cooling portion 67*b* that is a portion of the auxiliary cooling passage 67. The portion 67*a* of the auxiliary cooling passage 67 inside the exhaust guide 18 communicates with the auxiliary cooling portion 67*b* of the auxiliary cooling passage 67 inside the oil pan 61.

As shown in FIG. 5, the water pressure control valve 68 includes a valve seat 81 that defines a hole 80 through which water flowing to a downstream side of the auxiliary cooling passage 67 passes, a valve body 82 configured to open and close the valve seat 81 according to the water pressure inside the cooling water supply passage 30, a biasing member 83 that biases the valve body 82 in a closing direction, and a hollow cover 84 that constitutes at least a portion of the outer frame of the water pressure control valve 68. The hole 80 of the valve seat 81 causes the cooling water supply passage 30 and the auxiliary cooling passage 67 communicate with each other. The biasing member 83 is interposed between the valve body 82 and the cover 84. The biasing member 83 includes a compression coil spring. The cover 84 defines and functions as a communicating path defining member that defines, together with a portion 18*e* of an outer side surface 18*d* of the exhaust guide 18, a communicating path 85 that causes the cooling water supply passage 30 and the auxiliary cooling passage 67 communicate with each other at a portion lateral relative to the exhaust guide 18.

As shown in FIG. 4 and FIG. 5, the exhaust guide 18 includes an outer side surface 18*d* and an annular rib 86 that projects laterally from the outer side surface 18*d*. As shown in FIG. 5, an end surface 84*a* of the cover 84 abuts against an end surface 86*a* of the rib 86. The rib 86, the portion 18*e* of the outer side surface 18*d* of the exhaust guide 18 surrounded by the rib 86, and the hollow cover 84 define the communicating path 85 by demarcation.

As shown in FIG. 5, the exhaust guide 18 includes a communication hole 87 that causes the communicating path 85 to communicate with the cooling water supply passage 30 and a communication hole 88 that causes the communicating path 85 to communicate with the auxiliary cooling passage 67. As shown in FIG. 4, the communication hole 87 and the communication hole 88 open in the portion 18*e* of the outer side surface 18*d* surrounded by the rib 86. As shown in FIG. 5, the valve seat 81 is fitted with the communication hole 87 and fixed. The communicating path 85 inside the hollow cover 84 extends from the hole 80 of the valve seat 81 up to the communication hole 88.

Figure 7:
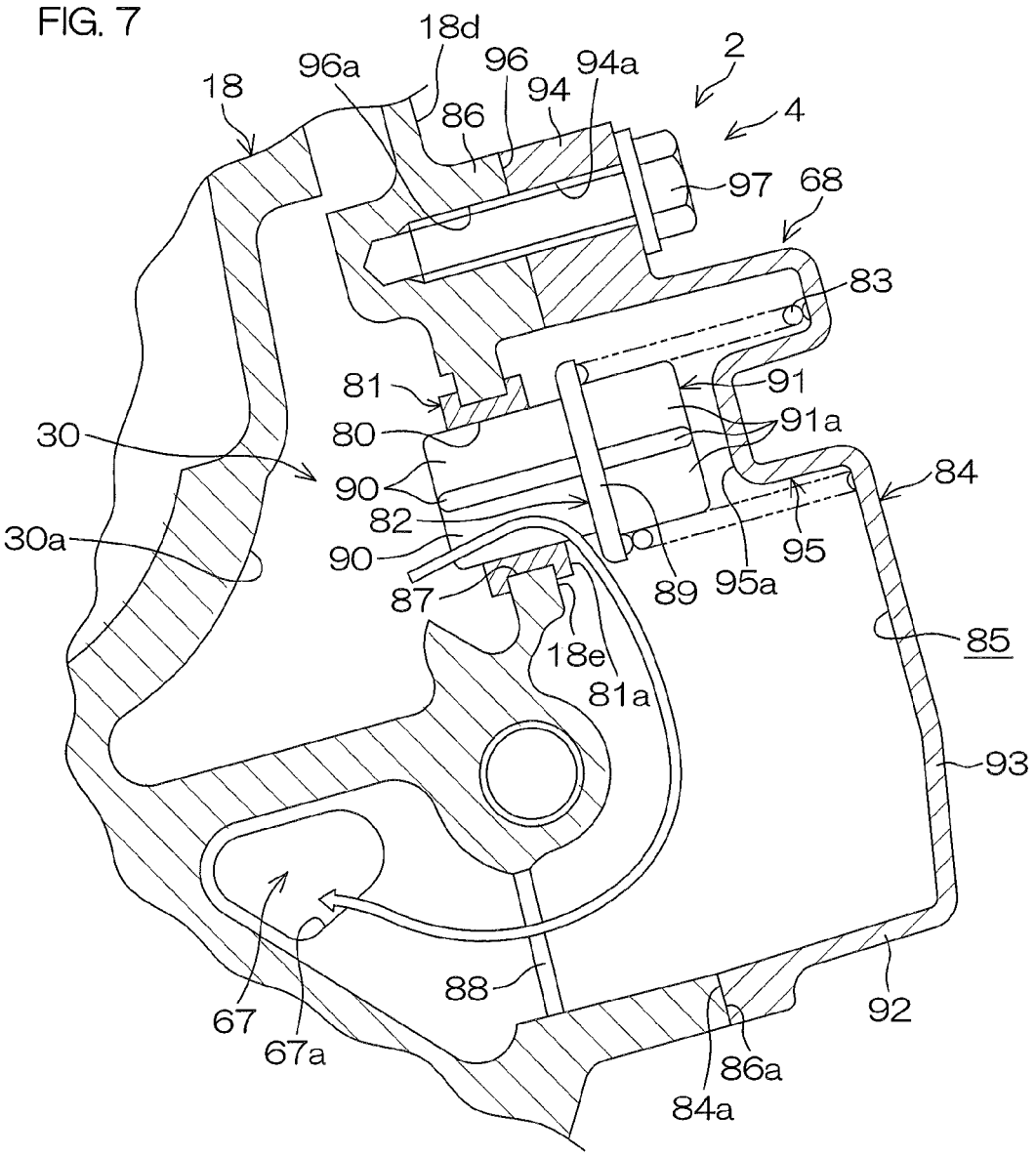
FIG. 7 is a sectional view of the principal portion of the exhaust guide and the water pressure control valve in an open state.

The valve body 82 includes a disk portion 89 opposed to a seat surface 81*a* of the valve seat 81, and a guided portion 90 extending from the disk portion 89 in an axial direction of the disk portion 89, axially slidably fitted with the inner periphery of the hole 80 of the valve seat 81, and to be axially guided by the hole 80. As shown in FIG. 5, by the disk portion 89 of the valve body 82 contacting the seat surface 81*a* of the valve seat 81, the hole 80 is blocked, and the water pressure control valve 68 reaches a closed state. As shown in FIG. 7, as a result of the disk portion 89 of the valve body 82 separating from the seat surface 81*a* of the valve seat 81, the hole 80 is opened, and the water pressure control valve 68 reaches an open state.

As shown in FIG. 5, the valve body 82 further includes a guide projection portion 91 extending from the disk portion 89 in a direction opposite to that of the guided portion 90, and defining and serving as a guide portion configured to guide an inner diameter portion at one end of the compression coil spring defining and serving as the biasing member 83. The guided portion 90 includes a plurality of ribs arrayed radially with respect to a central axis of the disk portion 89 and extending in the axial direction of the disk portion 89. The guide projection portion 91 includes a plurality of ribs 91*a* arrayed radially with respect to a central axis of the disk portion 89 and extending in the axial direction of the disk portion 89.

The cover 84 includes a peripheral wall 92, an end wall 93 coupled to one end of the peripheral wall 92, and a plurality of brackets 94 extending outward from the other end of the peripheral wall 92. The cover 84 further includes a guide projection portion 95 defining and serving as a guide portion, projecting from an inner surface of the end wall 93, to guide an inner diameter portion at the other end of the compression coil spring defining and serving as the biasing member 83. When the valve body 82 opens, by an end portion 95*a* of the guide projection portion 95 and a portion (ribs 91*a* of the guide projection portion 91) of the valve body 82 at the time of opening making contact with each other, the amount of movement of the valve body 82 is restricted. That is, the end portion 95*a* of the guide projection portion 95 is configured to define and function as a stopper that restricts the opening degree of the valve body 82 (corresponding to a distance between the valve body 82 and the valve seat 81).

As shown in FIG. 4, the rib 86 of the exhaust guide 18 includes a plurality of bracket receiving portions 96 that respectively receive the respective brackets 94. As shown in FIG. 5, each bracket 94 includes a screw insertion hole 94*a*. Each bracket receiving portion 96 includes a screw hole 96*a*. As a result of a fixing screw 97 inserted through the screw insertion hole 94*a* of each bracket 94 being screwed into the screw hole 96*a* of a corresponding bracket receiving portion 96, the cover 84 is fixed to the exhaust guide 18.

Figure 8:
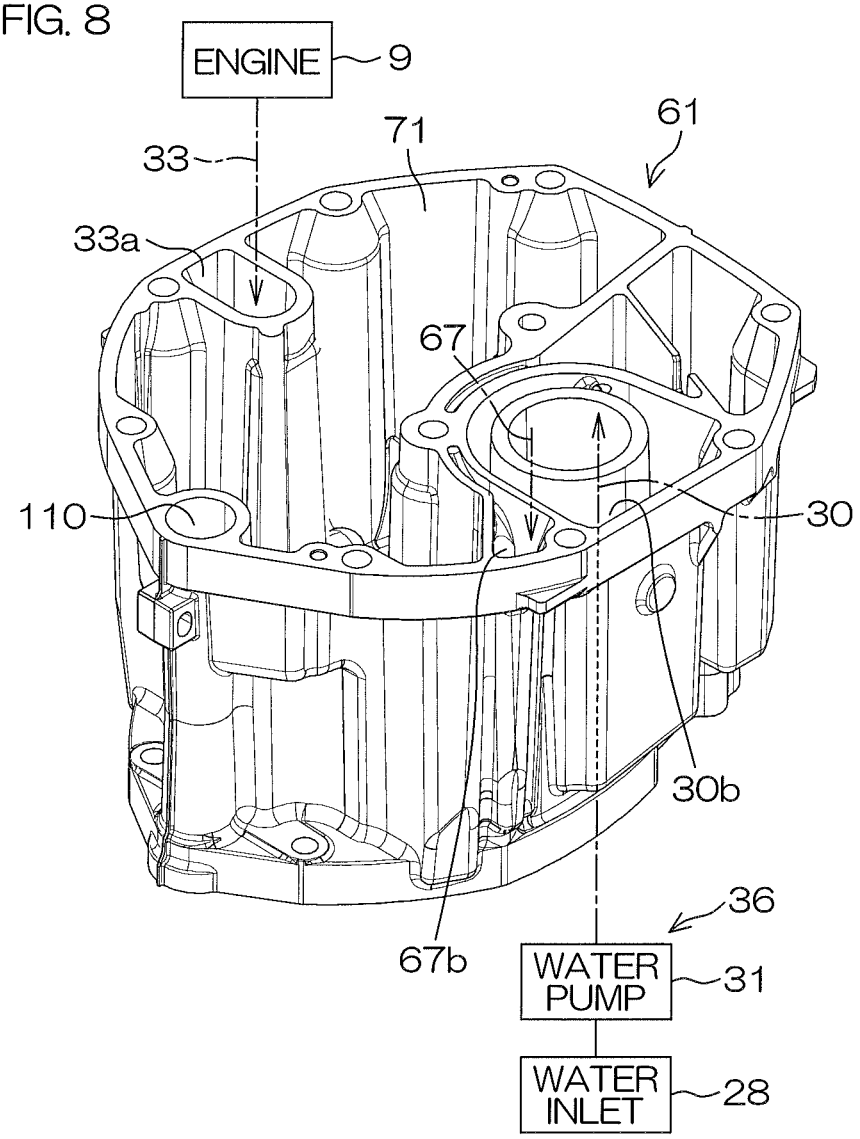
FIG. 8 is a schematic perspective view of the oil pan.

FIG. 8 is a perspective view of the oil pan 61. As shown in FIG. 8, the oil pan 61 includes the oil retaining portion 71, the water feed portion 30*b* being a portion of the cooling water supply passage 30, and the auxiliary cooling portion 67*b* being a portion of the auxiliary cooling passage 67 described above. The oil pan 61 further includes a drain portion 33*a* being a portion of the cooling water discharge passage 33. That is, the cooling water supply passage 30, the auxiliary cooling passage 67, and the cooling water discharge passage 33 extend along the oil pan 61. The water feed portion 30*b* of the cooling water supply passage 30, the auxiliary cooling portion 67*b* of the auxiliary cooling passage 67, and the drain portion 33*a* of the cooling water discharge passage 33 are provided in the interior of the oil pan 61. The water feed portion 30*b*, the drain portion 33*a*, and the auxiliary cooling portion 67*b* do not intersect in the interior of the oil pan 61.

As shown in FIG. 6, the auxiliary cooling passage 67 extends along the oil pan 61 from the upper end 61*a* up to a lower end 61*b* of the oil pan 61. The oil pan 61 includes a peripheral side wall 62 extending in the up-down direction, a bottom wall 63 coupled to a lower end portion of the peripheral side wall 62, and a partition wall 64 extending upward from the bottom wall 63. The oil retaining portion 71 is defined by being demarcated by a portion of the peripheral side wall 62, the partition wall 64, and the bottom wall 63. The oil retaining portion 71 and the auxiliary cooling portion 67*b* are partitioned via the partition wall 64.

The oil retaining portion 71 includes an opening 71*a* opened upward, an outer wall surface 71*b*, and an inner wall surface 71*c*. One wall surface of the partition wall 64 constitutes a portion of the outer wall surface 71*b* of the oil retaining portion 71. The other wall surface of the partition wall 64 constitutes a portion of the inner wall surface 71*c* of the oil retaining portion 71. The auxiliary cooling passage 67 extends along the outer wall surface 71*b* of the oil retaining portion 71 (corresponding to one surface of the partition wall 64).

As shown in FIG. 5, when the water pressure inside the cooling water supply passage 30 is less than a set pressure, the water pressure control valve 68 performs flow rate limitation to limit the amount of water flowing from the cooling water supply passage 30 to the auxiliary cooling passage 67. The flow rate limitation preferably includes a shutoff in which the flow-through of water from the cooling water supply passage 30 to the auxiliary cooling passage 67 is shut off. That is, the valve body 82 preferably completely closes the valve seat 81 in a state of the valve body 82 biased by the biasing member 83 being in contact with the valve seat 81. Also, for example, in the disk portion 89 of the valve body 82, a communication hole (not shown) that causes the section between the cooling water supply passage 30 and the auxiliary cooling passage 67 to communicate at all times preferably is provided.

As shown in FIG. 7, when the water pressure inside the cooling water supply passage 30 becomes the set pressure or more, the force by which the water pressure inside the cooling water supply passage 30 pushes the disk portion 89 exceeds an initial load of the biasing member 83. The valve body 82 pushed by the water pressure against the biasing member 83 thus separates from the seat surface 81*a* of the valve seat 81. As a result, a portion of the water inside the cooling water supply passage 30 is, as shown by the outline arrow in FIG. 7, caused to flow to the auxiliary cooling passage 67. The water is supplied to the oil pan 61 via the auxiliary cooling passage 67. When the water pressure inside the cooling water supply passage 30 is the set pressure or more, by the opening degree of the valve body 82 being adjusted according to the water pressure inside the cooling water supply passage 30, the amount of water that is caused to flow to the auxiliary cooling passage 67 from the cooling water supply passage 30 is adjusted. However, the maximum opening degree of the valve body 82 is restricted by the stopper (corresponding to the end portion 95*a* of the guide projection portion 95).

Figure 9:
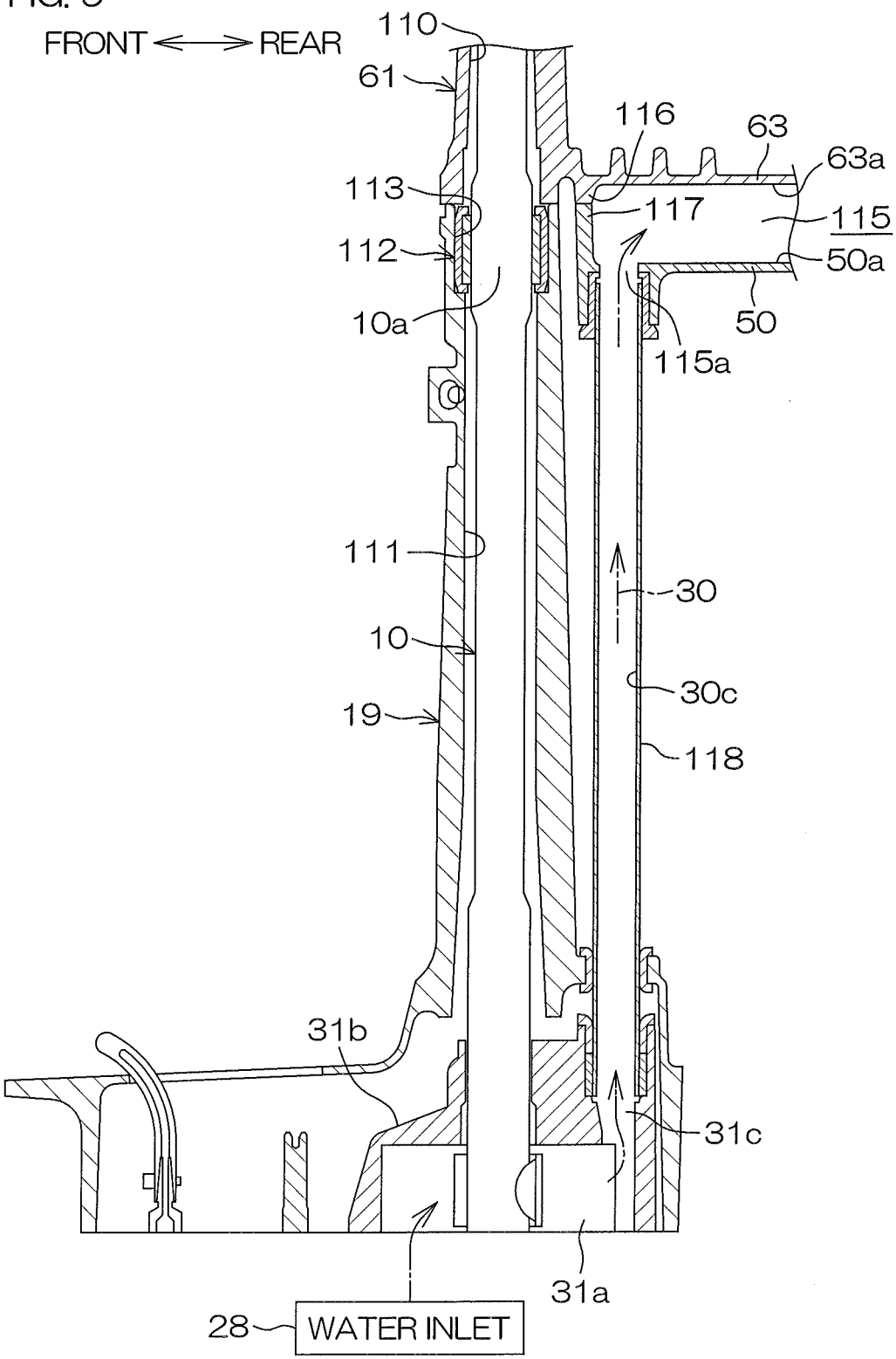
FIG. 9 is a schematic sectional view of the principal portion of the oil pan and the principal portion of an upper case.
Figure 10:
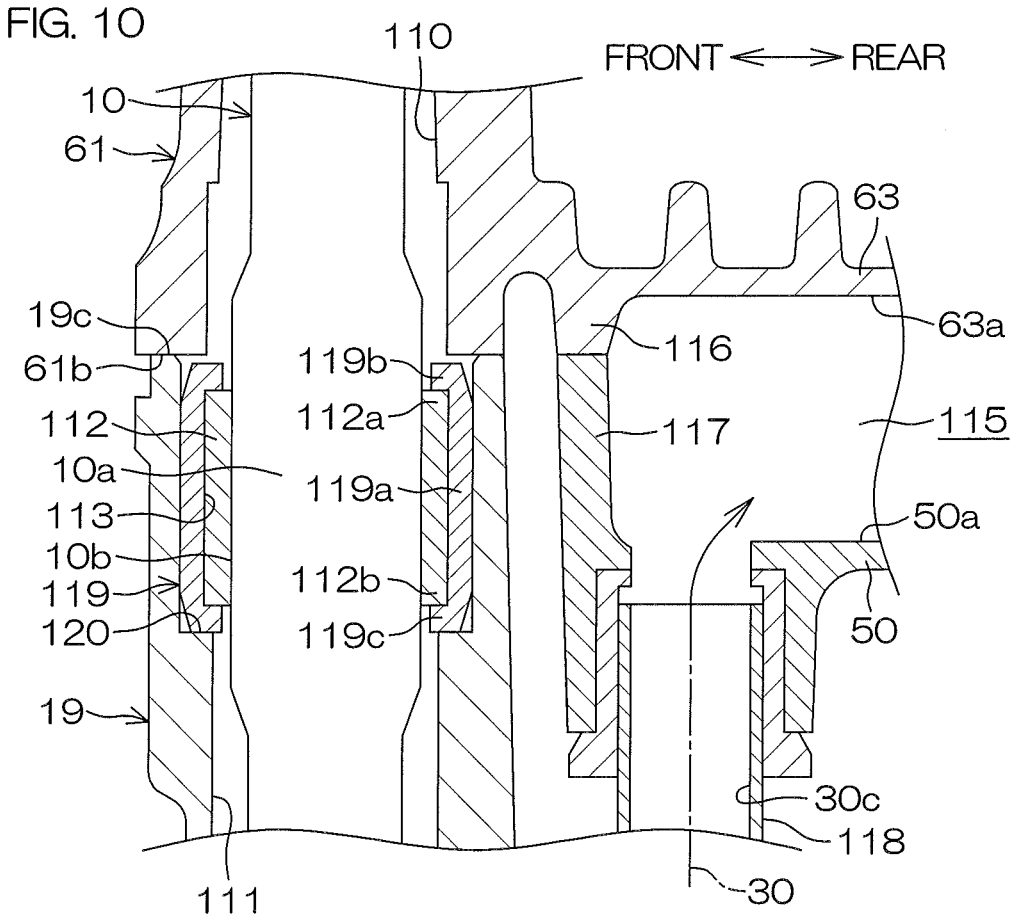
FIG. 10 is an enlarged sectional view of the principal portion of the oil pan and the principal portion of the upper case, and shows a portion of FIG. 9 in an enlarged manner.

FIG. 9 is a sectional view of the principal portion of the oil pan 61 and the upper case 19. FIG. 10 is an enlarged sectional view of the principal portion of the oil pan 61 and the upper case 19, and shows a portion of FIG. 9 in an enlarged manner.

As shown in FIG. 9, a cooling water passage 115 being a portion of the cooling water supply passage 30 is demarcated between a lower surface 63*a* of the bottom wall 63 of the oil pan 61 and an upper surface 50*a* of a plate 50 opposed to the lower surface 63*a* of the bottom wall 63. The cooling water passage 115 is surrounded by a partition wall 116 provided by being extended downward from the bottom wall 63 of the oil pan 61 and a partition wall 117 provided by being extended upward from the upper surface 50*a* of the plate 50.

The water pump 31 is disposed close to the lower end of the upper case 19. A portion of the pump case 31*b* of the water pump 31 is housed inside the upper case 19. A water feed portion 30*c* being a portion of the cooling water supply passage 30 is provided inside the upper case 19. The water feed portion 30*c* is demarcated, inside the upper case 19, by a water feed pipe 118 that causes a discharge port 31*c* of the pump case 31*b* of the water pump 31 and an inlet 115*a* of the cooling water passage 115 to communicate with each other.

Water that is taken to the inside of the pump case 31*b* from the water inlet 28 and discharged from the discharge port 31*c* by the action of the water pump 31 is delivered to the cooling water passage 115 via the water feed portion 30*c*. The water delivered to the cooling water passage 115 cools lubricating oil inside the oil pan 61 via the bottom wall 63 of the oil pan 61.

The upper end of the drive shaft 10 is splined to the crankshaft 38 in an integrally rotatable manner. An axially halfway portion 10*a* of the drive shaft 10 is rotatably supported by the bearing 112.

As shown in FIG. 10, the lower end 61*b* of the oil pan 61 and an upper end surface 19*c* of the upper case 19 abut against each other via a gasket (not shown). The oil pan 61 and the upper case 19 are preferably made of an aluminum material, for example. The drive shaft 10 preferably is made of, for example, stainless steel.

The bearing 112 includes a sliding bearing such as, for example, a cylindrical metal bearing containing copper that makes sliding contact with an outer periphery 10*b* of the axially halfway portion 10*a* of the drive shaft 10. The bearing 112 is non-rotatably held by a cylindrical bearing holder 119 held by the bearing holding portion 113 of the upper case 19. The bearing holder 119 is preferably made of an elastic member such as, for example, rubber. The bearing holder 119 is press-fitted into the bearing holding portion 113. The bearing holder 119 is elastically compressed inside the bearing holding portion 113.

The bearing holder 119 includes a cylindrical main body 119*a* that is fitted with the outer periphery of the bearing 112, and a pair of annular flanges 119*b* and 119*c* provided at both axial ends of the main body 119*a*. The main body 119*a* is interposed between the outer periphery of the bearing 112 and the bearing holding portion 113 to secure an insulating property between the outer periphery of the bearing 112 and the bearing holding portion 113.

The upper annular flange 119*b* is restricted from an axially upward movement by the lower end 61*b* of the oil pan 61. The lower annular flange 119*c* is restricted from an axially downward movement by an annular step portion 120 provided at the lower end of the bearing holding portion 113 of the upper case 19. The upper annular flange 119*b* is engaged with an upper end 112*a* of the bearing 112 to thus restrict an axially upward movement of the bearing 112. The upper annular flange 119*b* is interposed between the upper end 112*a* of the bearing 112 and the oil pan 61 to secure insulating property between the upper end 112*a* of the bearing 112 and the oil pan 61. The lower annular flange 119*c* is interposed between a lower end 112*b* of the bearing 112 and the annular step portion 120 of the upper case 19 to secure insulating property between the lower end 112*b* of the bearing 112 and the annular step portion 120 of the upper case 19.

Conventionally, a bearing to support a lower end portion of a drive shaft has been provided. However, there is a problem that the drive shaft has a great swing because a substantial support span corresponding to the distance from its upper end portion connected to the crankshaft to the bearing is long. In contrast thereto, in the present preferred embodiment, the substantial support span corresponding to the distance from the upper end portion of the drive shaft 10 to the bearing 112 is significantly reduced. The swing of the drive shaft 10 is thus suppressed to be small.

Also, in the present preferred embodiment, the bearing 112 is held by the bearing holding portion 113 of the upper case 19 via the bearing holder 119 being an elastic member. Thus, by elastic deformation of the bearing holder 119, errors in the dimensional accuracy and the positional accuracy of combination, etc., of the drive shaft 10 and the upper case 19 are absorbed.

On the other hand, in the case of supporting the bearing 112 by the bearing holder 119 being an elastic member such as rubber, there is a concern about the occurrence of a new problem that the bearing holder 119 deteriorates due to heat generated by sliding friction between the drive shaft 10 and the bearing 112.

Figure 12:
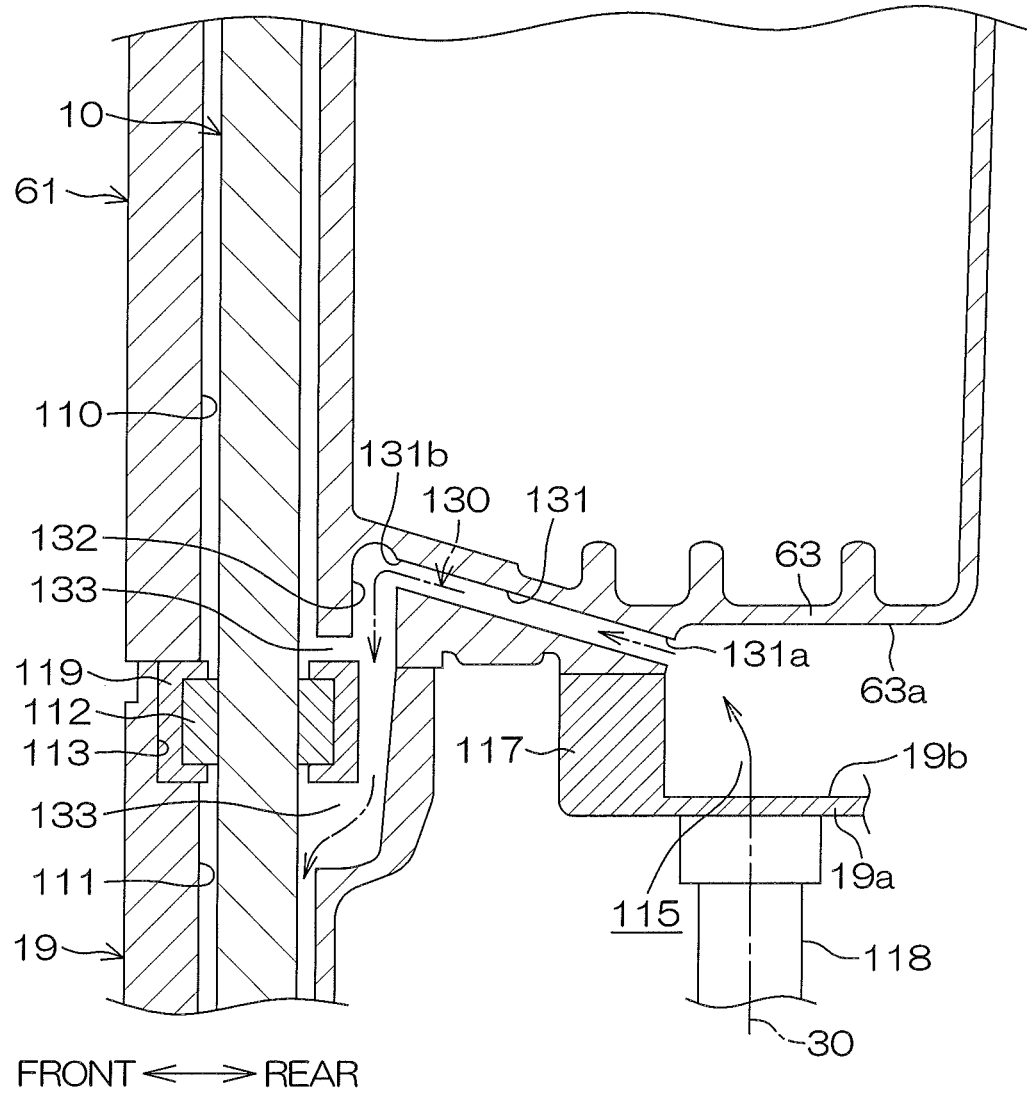
FIG. 12 is an enlarged sectional view of the principal portion of the oil pan and the principal portion of the upper case, and corresponds to a section cut by a plane along line XII-XII in FIG. 11.

In contrast thereto, in the present preferred embodiment, as shown in FIG. 12 to be described later, water flowing in the branch passage 130 branching from a halfway portion of the cooling water supply passage 30 suppresses or prevents a rise in temperature of the bearing holder 119 by flowing so as to pass through a portion of the bearing holding portion 113. A deterioration of the bearing holder 119 is thus suppressed or prevented.

Figure 11:
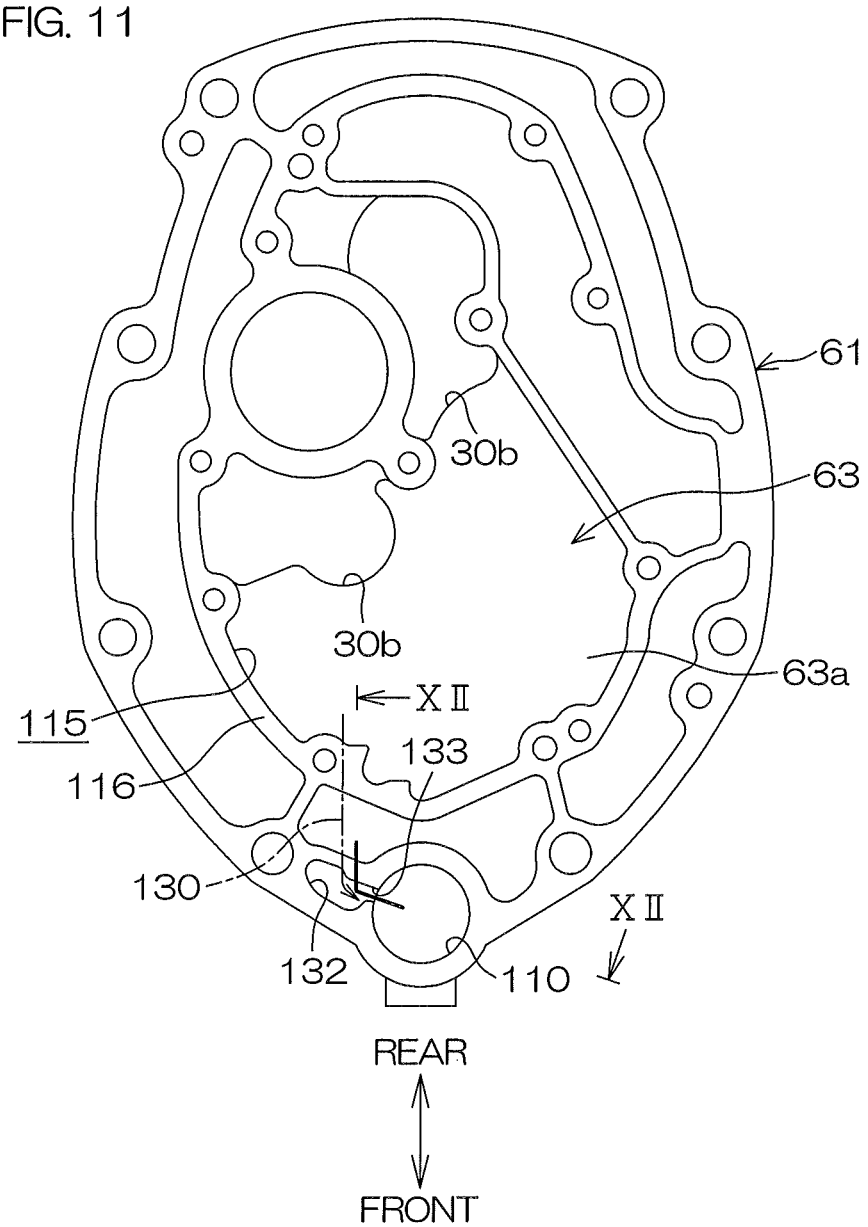
FIG. 11 is a bottom view of the oil pan.
Figure 13:
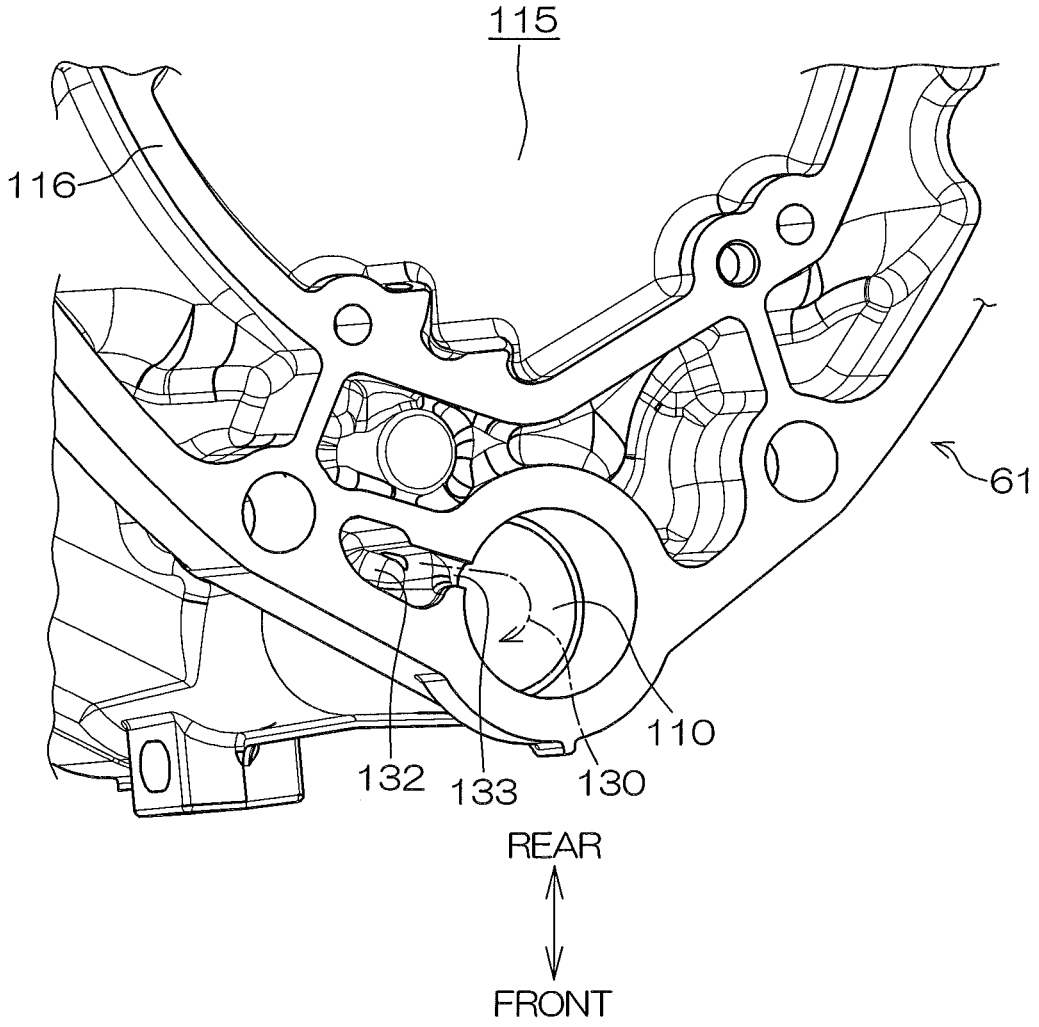
FIG. 13 is a schematic perspective view of the principal portion of the oil pan from obliquely below.

Next, description will be given of a structure of the branch passage 130 branching from a halfway portion of the cooling water supply passage 30 for flowing to the bearing 112 side. FIG. 11 is a bottom view of the oil pan 61, and FIG. 12 is a sectional view of the principal portion of the oil pan 61 and the principal portion of the upper case 19 cut by a plane along line XII-XII in FIG. 11. FIG. 13 is a schematic perspective view of the principal portion of the oil pan 61 from obliquely below.

As shown in FIG. 11, in a bottom portion of the oil pan 61, a portion of the cooling water passage 115 is defined by the bottom wall 63 and the annular partition wall 116 projecting downward from the bottom wall 63. In the portion of the lower surface 63*a* of the bottom wall 63 surrounded by the partition wall 116, one end of the water feed portion 30*b* being a portion of the cooling water supply passage 30 opens in, for example, two spots.

Referring to FIG. 11 to FIG. 13, the branch passage 130 causes the cooling water passage 115 being a portion of the cooling water supply passage 30 and a portion of the insertion holes 110 and 111 to communicate with each other. The branch passage 130 includes a first passage 131, a second passage 132, and a third passage 133. As shown in FIG. 12, water inside the cooling water passage 115 is, as shown in FIG. 12, delivered to a portion of the insertion holes 110 and 111 sequentially via the first passage 131, the second passage 132, and the third passage 133.

The first passage 131 includes a first end portion 131*a* connected to the cooling water passage 115, and a second end portion 131*b* connected to the second passage 132. The first passage 131 extends by penetrating through the bottom wall 63 of the oil pan 61 in an inclined manner. The second end portion 131*b* is disposed higher than the first end portion 131*a*. The second passage 132 is, in a mode of extending across the oil pan 61 and the upper case 19, disposed close to the insertion holes 110 and 111. The second passage 132 extends parallel or substantially parallel to the insertion holes 110 and 111. The third passage 133 extends substantially in the radial direction of the insertion holes 110 and 111 to cause the second passage 132 communicate with a portion in the circumferential direction of the insertion holes 110 and 111.

Water inside the cooling water supply passage 30 before engine cooling flows, via the branch passage 130, passing through a portion of the bearing holding portion 113 of the insertion hole 111 of the upper case 19. A rise in temperature of the bearing holder 119 held by the bearing holding portion 113 is thus suppressed or prevented. As a result, a deterioration of the bearing holder 119 is suppressed or prevented to improve the durability of the bearing holder 119. The water having passed through a portion of the bearing holding portion 113 falls along the insertion hole 111 of the upper case 19, and is returned to, for example, the inside of the pump case 31*b*.

During driving of the water pump 30, by water that is caused to flow to the bearing holding portion 113 via the branch passage 130, the bearing 112 and its peripheral portion are washed at all times. That is, the bearing 112 and its peripheral portion are always supplied with new seawater. Seawater is thus never retained in the bearing 112 and its peripheral portion. Also, at the time of ordinary maintenance where the cooling water passage 29 (water jacket) etc., is washed by passing water from the exterior through a water port (not shown), the bearing 112 and its periphery are also simultaneously washed.

According to the present preferred embodiment, the following excellent effects are provided. That is, when the output of the engine 9 is low, the water pressure inside the cooling water supply passage 30 is low. When the output of the engine 9 is high, the water pressure inside the cooling water supply passage 30 is high. When the water pressure inside the cooling water supply passage 30 is less than the set pressure, because the flow rate of water flowing from the cooling water supply passage 30 to the auxiliary cooling passage 67 is limited, the flow rate of water to be supplied to the oil pan 61 via the auxiliary cooling passage 67 is also limited. The cooling ability is thus suppressed. When the water pressure inside the cooling water supply passage 30 is the set pressure or more, low-temperature water before cooling the engine 9, as shown in FIG. 7, flows from the cooling water supply passage 30 to the auxiliary cooling passage 67, and is supplied to the oil pan 61 via the auxiliary cooling passage 67. The cooling ability to cool lubricating oil inside the oil pan 61 is thus enhanced. Thus, a temperature difference of the lubricating oil between when the output of the engine 9 is high and low is significantly reduced.

The flow rate limitation that is carried out by the water pressure control valve 68 when the water pressure inside the cooling water supply passage 30 is less than the set pressure preferably includes a shutoff to shut off flow-through of water from the cooling water supply passage 30 to the auxiliary cooling passage 67. The shutoff keeps the inside of the auxiliary cooling passage 67 empty. That is, when the output of the engine 9 is low, the flow of water to the auxiliary cooling passage 67 is shut off to cancel cooling of the oil pan 61 by water inside the auxiliary cooling passage 67. Thus, excessively cooling the lubricating oil is suppressed or prevented when the output of the engine 9 is low. A temperature difference of the lubricating oil between when the output of the engine 9 is high and low is further reduced as much as possible.

Even without increasing the passage area of the cooling water supply passage 30 to the engine 9, the flow rate of cooling water that cools lubricating oil is significantly increased. The water that is supplied from the branch position of the cooling water supply passage 30 to the oil pan 61 via the auxiliary cooling passage 67 at the time of the set pressure or more is water that is relieved so that the amount of cooling water supply to the engine 9 does not become excessive. Thus, a situation such that the amount of cooling water supply to the engine 9 becomes insufficient does not occur.

As shown in FIG. 4, the auxiliary cooling passage 67 branches from the cooling water supply passage 30 at the branch position higher than the oil pan 61, and as shown in FIG. 3, the water pressure control valve 68 is disposed higher than the oil pan 61. The length of the auxiliary cooling passage 67 that contributes to cooling is thus prolonged. The cooling ability when the engine output is large is greatly enhanced. A temperature difference of the lubricating oil between when the output of the engine 9 is high and low is further reduced as much as possible.

As shown in FIG. 6, the auxiliary cooling passage 67 extends along the oil pan 61 from the upper end 61*a* of the oil pan 61 up to the lower end 61*b* of the oil pan 61. The length of the auxiliary cooling passage 67 that contributes to cooling is thus maximized. The cooling ability when the output of the engine 9 is large is markedly enhanced. A temperature difference of the lubricating oil between when the output of the engine 9 is high and low is further reduced as much as possible.

As shown in FIG. 6, the oil pan 61 includes an oil retaining portion 71 that retains lubricating oil L1 to be supplied to the engine 9, and the auxiliary cooling passage 67 extends along the outer wall surface 71*b* of the oil retaining portion 71. Thus, the outer wall surface 71*d* of the oil retaining portion 71 is effectively cooled by water flowing inside the auxiliary cooling passage 67. The cooling ability to cool lubricating oil L1 inside the oil retaining portion 71 is greatly enhanced.

As shown in FIG. 1 and FIG. 2, the cooling water supply passage 30 extends from the water inlet 28 to the engine 9, and as shown in FIG. 2 and FIG. 8, extends along the oil pan 61. Thus, the cooling ability is further enhanced by cooling the oil pan 61 by low-temperature water before engine cooling flowing inside the cooling water supply passage 30.

As shown in FIG. 2, the vessel propulsion apparatus 2 includes a cooling water exhaust passage 33 that extends from the engine 9 to the oil pan 61 and through which water supplied from the cooling water supply passage 30 to the engine 9 flows. Thus, the cooling ability is further enhanced by also making water after cooling the engine 9 contribute to cooling of the oil pan 61.

As shown in FIG. 8, in the interior of the oil pan 61, a water feed portion 30*b* of the cooling water supply passage 30, a drain portion 33*a* of the cooling water discharge passage 33, and an auxiliary cooling portion 67*b* of the auxiliary cooling passage 67 are preferably provided. The water feed portion 30*b*, the drain portion 33*a*, and the auxiliary cooling portion 67*b* do not intersect in the interior of the oil pan 61. The contact area of the oil pan 61 with water is thus increased inside the oil pan 61, so that the cooling ability is further enhanced.

As shown in FIG. 1, the water pump 31 includes a rotor (impeller 31*a*) that is driven to rotate by the engine 9 so that the discharge flow rate of water increases with an increase in the rotation speed of the engine 9. Thus, the water pressure inside the cooling water supply passage 30 increases or decreases depending on the rotation speed of the engine 9. By the water pressure control valve 68 controlling the amount of water to be supplied to the oil pan 61 via the auxiliary cooling passage 67 according to the water pressure inside the cooling water supply passage 30, the cooling ability is controlled.

As shown in FIG. 5, the water pressure control valve 68 includes a valve seat 81 that defines the hole 80 through which water flowing to the downstream side of the auxiliary cooling passage 67 passes, and a valve body 82 that opens and closes the valve seat 81 according to the water pressure inside the cooling water supply passage 30. Thus, by the valve body 82 opening and closing the valve seat 81, the amount of water flowing to the downstream side of the auxiliary cooling passage 67 is controlled. The opened/closed valve body 82 closes the valve seat 81, as shown in FIG. 5, when the output of the engine 9 is low, which also makes shutting off the flow-through of water to the auxiliary cooling passage 67 easy. Thus, excessively cooling the lubricating oil is suppressed or prevented when the output of the engine 9 is low. A temperature difference of the lubricating oil between when the output of the engine 9 is high and low is further reduced as much as possible.

Figure 14:
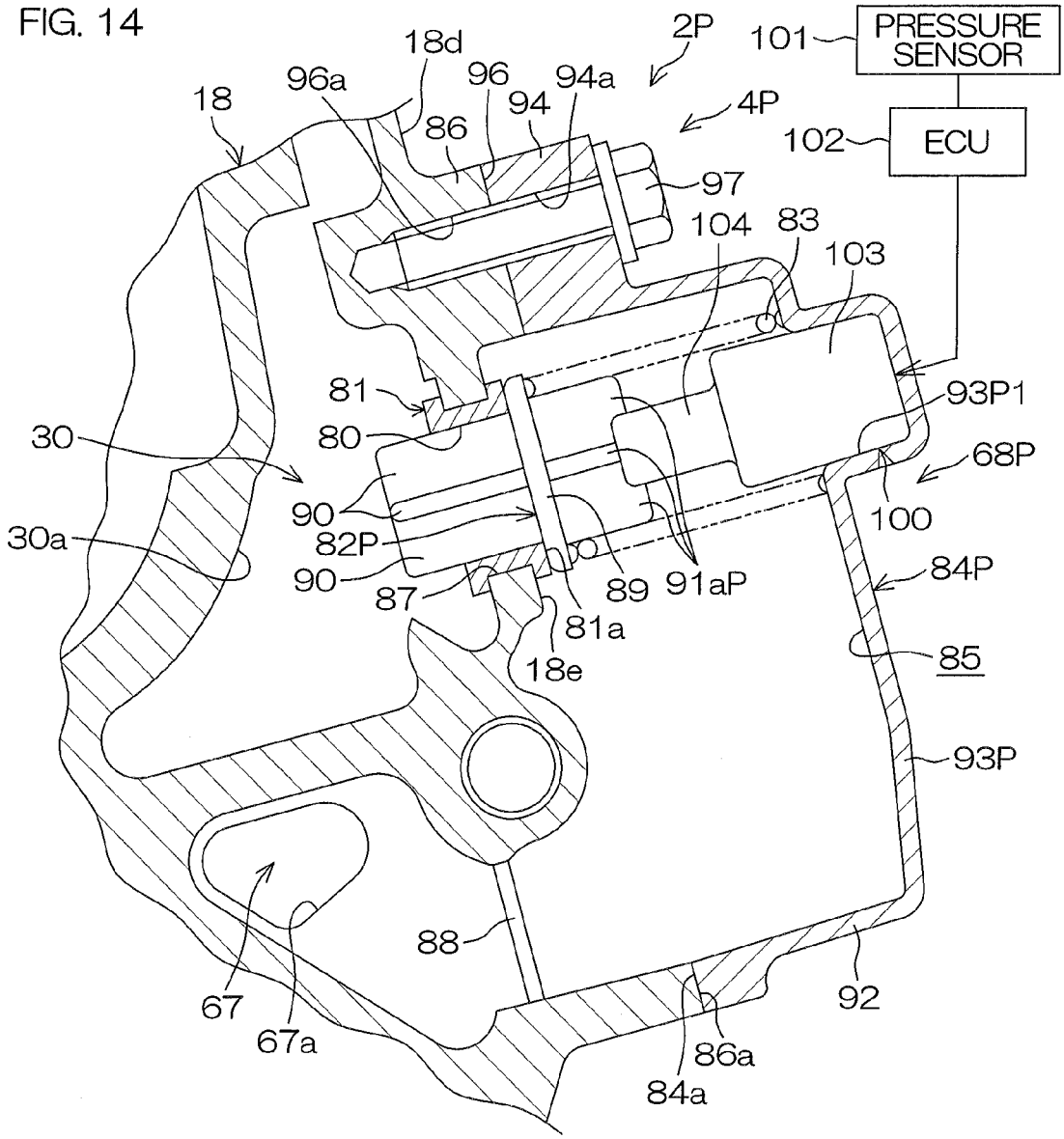
FIG. 14 is a schematic sectional view of the principal portion of an exhaust guide and a water pressure control valve according to a second preferred embodiment of the present invention.

FIG. 14 shows a sectional view of a water pressure control valve and an exhaust guide according to a second preferred embodiment of the present invention. The second preferred embodiment in FIG. 14 is mainly different from the first preferred embodiment in FIG. 5 as follows. That is, an outboard motor 4P of a vessel propulsion apparatus 2P according to the second preferred embodiment in FIG. 14 includes an electrically-operated water pressure control valve 68P as a pressure control valve including an electric actuator 100, a pressure sensor 101 configured to sense the pressure inside the cooling water supply passage 30, and an ECU (Electronic Control Unit) 102 that is configured or programmed to drive-control the electric actuator 100 based on a signal from the pressure sensor 101.

The electric actuator 100 is configured to move a valve body 82P of the water pressure control valve 68P. Specifically, the electronic actuator 100 includes a fixed portion 103 fixed to a hollow cover defining and serving as a cover 84P, and a movable portion 104 that elongates and contracts from the fixed portion 103. By contraction of the movable portion 104 of the electric actuator 100, the valve body 82P is opened. By elongation of the movable portion 104 of the electric actuator 100, the valve body 82P is closed.

For example, the electric actuator 100 is preferably constituted by a solenoid that is drive-controlled by the ECU 102. The solenoid defining and serving as the electric actuator 100 includes a solenoid main body defining and serving as a fixed portion 103, and a control rod coupled to the valve body 82P and defining and serving as a movable portion 104 that elongates and contracts from the solenoid main body. The fixed portion 103 preferably is fixed by being fitted with a holding recess portion 93P1 provided in an inner surface of an end wall 93P of the hollow cover 84P. The outer periphery of the fixed portion 103 preferably is configured to guide an inner diameter portion at one end of a compression coil spring defining and serving as a biasing member 83. The movable portion 104 preferably is coupled to ribs 91*a*P that guide the biasing portion 83, or preferably is coupled to a disk portion 89, for example.

By the ECU 102 exciting the solenoid, the control rod is caused to contract against the biasing member 83. As a result, the valve body 82P is opened. By the ECU 102 cancelling the excitation of the solenoid, the control rod is elongated by the action of the biasing member 83. As a result, the valve body 82P is closed.

Of the components of the second preferred embodiment in FIG. 14, components that are the same as the components of the first preferred embodiment in FIG. 5 are denoted by the same reference signs as the reference signs of the components of the first preferred embodiment in FIG. 5. According to the second preferred embodiment, the valve body 82P is preferably driven using the electric actuator 100. Because the biasing member 83 does not need to determine the set pressure, accuracy is not required for the initial load of the biasing member 83. Because the water pressure of the cooling water supply passage 30 is directly sensed by the pressure sensor 101, the set pressure is accurately set. The valve body 82P is reliably caused to operate at the accurately set pressure.

Figure 15:
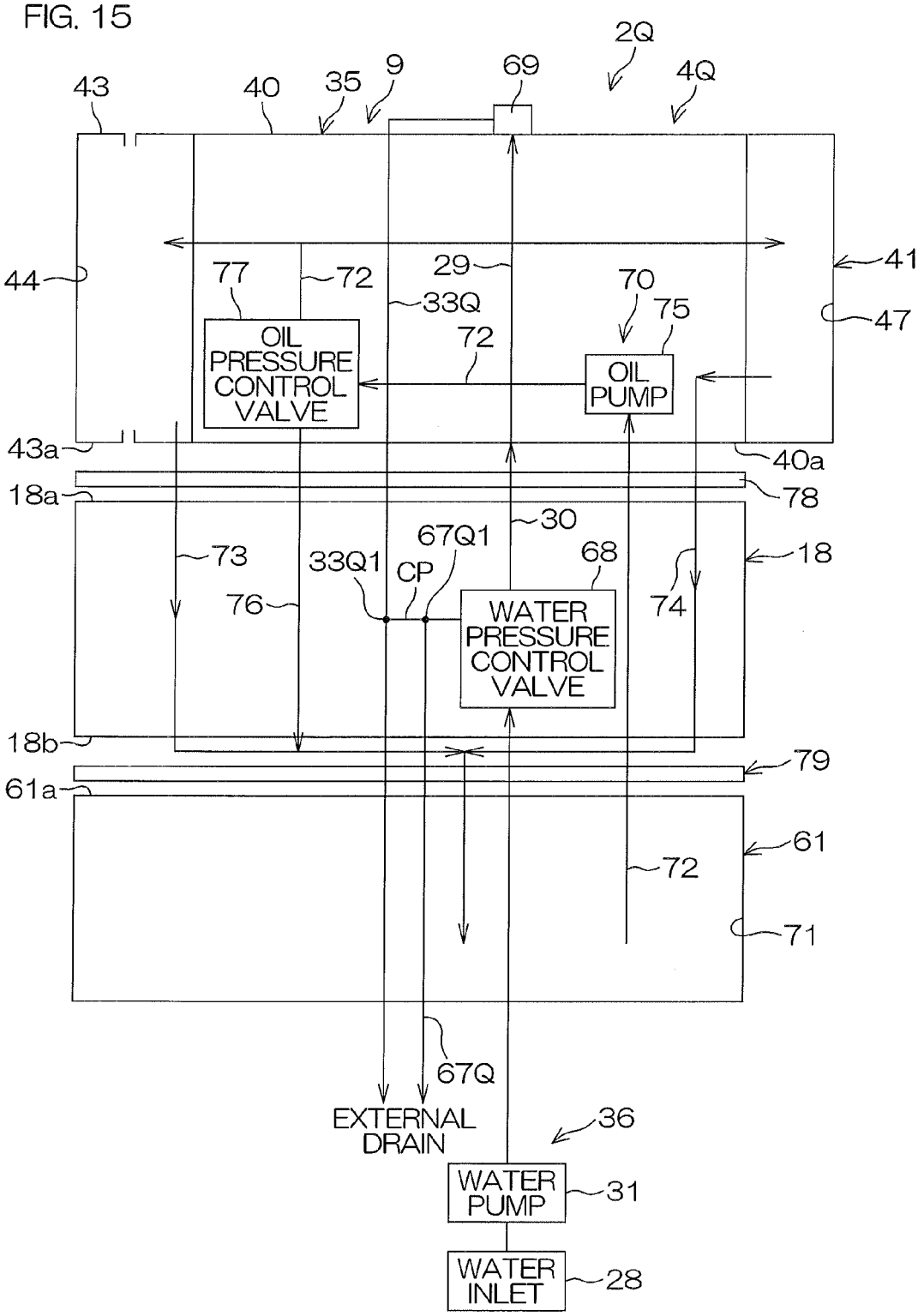
FIG. 15 is a block diagram schematically showing flows of cooling water and lubricating oil according to a third preferred embodiment of the present invention.

FIG. 15 is a block diagram schematically showing flows of cooling water and lubricating oil according to a third preferred embodiment of the present invention. The third preferred embodiment in FIG. 15 is mainly different from the first preferred embodiment in FIG. 2 as follows. That is, in the first preferred embodiment of FIG. 2, the cooling water discharge passage 33 to discharge cooling water after cooling the engine 9 to the exterior and the auxiliary cooling passage 67 extending to the oil pan 61 from the branch position of the cooling water supply passage 30 are independent of each other. In contrast thereto, in the third preferred embodiment of FIG. 15, an outboard motor 4Q of a vessel propulsion apparatus 2Q includes a communicating path CP that causes a halfway portion 33Q1 of a cooling water discharge passage 33Q and a halfway portion 67Q1 of an auxiliary cooling passage 67Q to communicate with each other.

Of the components of the third preferred embodiment in FIG. 15, components that are the same as the components of the first preferred embodiment in FIG. 2 are denoted by the same reference signs as the reference signs of the components of the first preferred embodiment in FIG. 2. According to the third preferred embodiment, water branching from the cooling water supply passage 30 to be discharged to the exterior is, by two systems of the cooling water discharge passage 33Q and the auxiliary cooling passage 67Q, caused to flow along the oil pan 61. Because the area of cooling water branching at the water pressure control valve 68 contacting the oil pan 61 is increased, the cooling ability is enhanced.

The present invention is not limited to the preferred embodiments. For example, in the preferred embodiments, the auxiliary cooling passage 67 is preferably provided in the interior of the oil pan 61. Without being limited thereto, the auxiliary cooling passage may be provided in the exterior of an oil pan, and extend along the oil pan. For example, the auxiliary cooling passage may be defined between an outer wall surface of an oil pan and an upper case, and extend along the oil pan.

In the preferred embodiments, the auxiliary cooling passage 67 preferably extends along the oil pan from the upper end 61*a* up to the lower end 61*b* of the oil pan 61. Without being limited thereto, it suffices that the auxiliary cooling passage extends along at least a portion in the up-down direction of an oil pan.

In the preferred embodiments, the cooling water supply passage 30 is preferably provided in the interior of the oil pan 61. Without being limited thereto, the cooling water supply passage may be provided in the exterior of an oil pan, and extend along the oil pan. For example, the cooling water supply passage may be defined between an outer wall surface of an oil pan and an upper case, and extend along the oil pan.

In the preferred embodiments, the cooling water supply passage 30 inside the exhaust guide 18 preferably communicates with the auxiliary cooling passage 67 inside the exhaust guide 18 via the communicating path 85 along the outer side surface 18*d* of the exhaust guide 18. Without being limited thereto, the cooling water supply passage inside an exhaust guide may communicate with an auxiliary cooling passage inside the exhaust guide via a communicating path provided in the interior of the exhaust guide. In this case, a water pressure control valve (pressure control valve) is disposed in the interior of the exhaust guide.

In the preferred embodiments, the vessel propulsion apparatus preferably includes an outboard motor. Without being limited thereto, the vessel propulsion apparatus may include an inboard motor, or may include an inboard/outboard motor, for example.

In the following, various preferred embodiments of the present invention will be described in greater detail with reference to examples.

Example 1 is a vessel propulsion apparatus that, as in the first preferred embodiment of the present invention as shown in FIG. 2, discharges cooling water from the cooling water supply passage 30 to the exterior via the auxiliary cooling passage 67 along the oil pan 61.

Comparative Example 1 is a vessel propulsion apparatus that releases cooling water to the exterior via a cooling water relief passage branching from a cooling water supply passage by the action of a water pressure control valve. Water in the cooling water relief passage does not contribute to cooling of an oil pan.

Example 1 and Comparative Example 1 were used to carry out a measurement experiment to determine the relationship between the rotation speed of an engine and the temperature of lubricating oil inside an oil pan.

Figure 16:
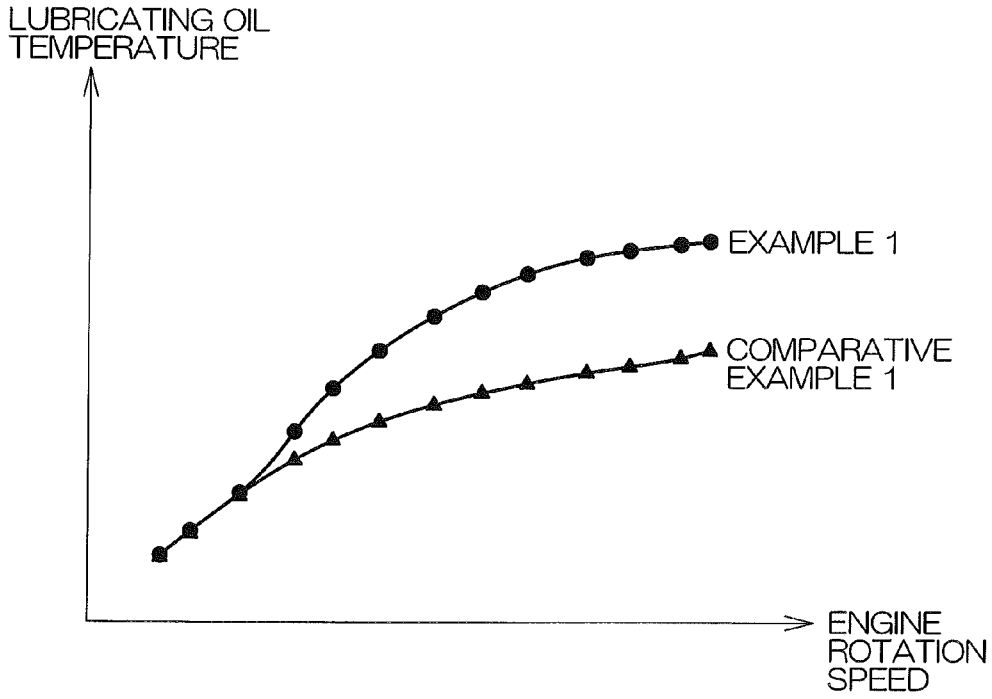
FIG. 16 is a graphic illustration showing the relationship of the rotation speed of an engine and the temperature of lubricating oil inside an oil pan, in which a comparison of Example 1 according to a preferred embodiment of the present invention and Comparative Example 1 in which water branching from a cooling water supply passage to be discharged to the exterior is not used to cool the oil pan is shown.

As a result of the measurement experiment, it has been verified that, as shown in FIG. 16, in a rotation speed range not less than an engine speed corresponding to a set pressure of the water pressure control valve, the lubricating oil temperature in Example 1 is suppressed lower than the lubricating oil temperature in Comparative Example 1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The present application corresponds to Japanese Patent Application No. 2013-232397 filed in the Japanese Patent Office on Nov. 8, 2013, and the entire disclosure of this application is incorporated herein by reference.

What is claimed is:

1. A vessel propulsion apparatus comprising:

an engine that generates power to propel a vessel;

an oil pan that retains lubricating oil to be supplied to the engine;

a water inlet disposed under the engine;

a cooling water supply passage extending from the water inlet to the engine;

a water pump that is disposed in the cooling water supply passage, and that takes in water outside of the vessel propulsion apparatus from the water inlet and supplies the taken-in water to the engine via the cooling water supply passage, by being driven by the engine;

an auxiliary cooling passage branching from the cooling water supply passage at a branch position between the engine and the water pump and extending from the branch position to the oil pan; and a pressure control valve that performs flow rate limitation to limit a flow rate of water flowing from the cooling water supply passage to the auxiliary cooling passage when a water pressure inside the cooling water supply passage is less than a set pressure, and that cancels the flow rate limitation to allow a portion of the water inside the cooling water supply passage to flow to the auxiliary cooling passage when the water pressure inside the cooling water supply passage is the set pressure or more to maintain the water pressure inside the cooling water supply passage to be less than the set pressure, and to supply water to the oil pan via the auxiliary cooling passage.

2. The vessel propulsion apparatus according to claim 1, wherein the flow rate limitation includes a shutoff in which the pressure control valve shuts off flow-through of water from the cooling water supply passage to the auxiliary cooling passage; and the pressure control valve keeps an inside of the auxiliary cooling passage empty by shutting off flow-through of water from the cooling water supply passage to the auxiliary cooling passage when the water pressure inside the cooling water supply passage is less than the set pressure.

3. The vessel propulsion apparatus according to claim 1, wherein the auxiliary cooling passage branches from the cooling water supply passage at the branch position higher than the oil pan; and the pressure control valve is disposed higher than the oil pan.

4. The vessel propulsion apparatus according to claim 3, wherein the auxiliary cooling passage extends along the oil pan from an upper end of the oil pan up to a lower end of the oil pan.

5. The vessel propulsion apparatus according to claim 1, wherein the oil pan includes an oil retaining portion that retains lubricating oil to be supplied to the engine; and the auxiliary cooling passage extends along an outer wall surface of the oil retaining portion.

6. The vessel propulsion apparatus according to claim 1, wherein the cooling water supply passage extends from the water inlet to the engine and extends along the oil pan.

7. The vessel propulsion apparatus according to claim 1, further comprising a cooling water exhaust passage that extends from the engine to the oil pan and through which water supplied from the cooling water supply passage to the engine flows.

8. The vessel propulsion apparatus according to claim 7, wherein the cooling water supply passage includes a water feed portion provided in an interior of the oil pan;

the cooling water discharge passage includes a drain portion provided in the interior of the oil pan;

the auxiliary cooling passage includes an auxiliary cooling portion provided in the interior of the oil pan; and the water feed portion, the drain portion, and the auxiliary cooling portion do not intersect in the interior of the oil pan.

9. The vessel propulsion apparatus according to claim 1, wherein the water pump includes a rotor that is driven to rotate by the engine so that a discharge flow rate of water increases with an increase in a rotation speed of the engine.

10. The vessel propulsion apparatus according to claim 1, wherein the pressure control valve includes a valve seat that defines a hole through which water flowing to a downstream side of the auxiliary cooling passage passes, and a valve body that opens and closes the hole by contacting and separating from the valve seat according to the water pressure inside the cooling water supply passage.

11. The vessel propulsion apparatus according to claim 10, wherein the pressure control valve further includes an electric actuator that moves the valve body.

12. The vessel propulsion apparatus according to claim 1, wherein the engine includes a crankshaft that is rotatable about a rotation axis extending in an up-down direction.

13. The vessel propulsion apparatus according to claim 12, comprising:

a drive shaft that is disposed under the crankshaft and coupled with the crankshaft in an integrally rotatable manner and that drives the water pump;

a casing including an insertion hole through which the drive shaft is inserted and a bearing holding portion provided on an inner periphery of the insertion hole; and a bearing that is held by the bearing holding portion and rotatably supports an axially halfway portion of the drive shaft.

14. The vessel propulsion apparatus according to claim 13, further comprising a bearing holder held by the bearing holding portion and including a cylindrical elastic member that holds the bearing.

15. The vessel propulsion apparatus according to claim 14, further comprising a branch passage branching from a halfway portion of the cooling water supply passage, passing through a portion of the bearing holding portion to communicate with the insertion hole, wherein the bearing includes a cylindrical sliding bearing that makes sliding contact with an outer periphery of the halfway portion of the drive shaft.

* * * * *